US010066813B2

(12) United States Patent
Poorter et al.

(10) Patent No.: US 10,066,813 B2
(45) Date of Patent: Sep. 4, 2018

(54) LED SOCKET ASSEMBLY

(71) Applicant: TE Connectivity Nederland BV, s'Hertogenbosch (NL)

(72) Inventors: Peter Poorter, Wijken Aalburg (NL); Jeroen Iedema, Wolvega (NL); Olaf Leijnse, Asten (NL)

(73) Assignee: TE Connectivity Nederland BV, s'Hertogenbosch (NL)

( * ) Notice: Subject to any disclaimer, the term of this patent is extended or adjusted under 35 U.S.C. 154(b) by 0 days.

(21) Appl. No.: 15/200,065

(22) Filed: Jul. 1, 2016

(65) Prior Publication Data

US 2016/0312984 A1 Oct. 27, 2016

Related U.S. Application Data

(63) Continuation of application No. PCT/EP2014/050031, filed on Jan. 2, 2014.

(51) Int. Cl.
*F21V 19/00* (2006.01)
*F21V 23/00* (2015.01)
(Continued)

(52) U.S. Cl.
CPC ..... *F21V 19/004* (2013.01); *F21K 9/00* (2013.01); *F21V 19/003* (2013.01);
(Continued)

(58) Field of Classification Search
CPC .. F21V 19/004; F21V 19/0055; F21V 19/002; F21V 23/06; F21V 23/001; F21V 23/02
See application file for complete search history.

(56) References Cited

U.S. PATENT DOCUMENTS 4,728,235 A * 3/1988 Patti ..... F16B 2/065 411/174
7,549,786 B2 * 6/2009 Higley ..... F21L 4/027 362/640
(Continued)

FOREIGN PATENT DOCUMENTS

EP 2333398 A2 6/2011
EP 2333405 A2 6/2011
(Continued)

OTHER PUBLICATIONS

Written Opinion of the International Searching Authority, PCT/EP2014/050031, dated Nov. 12, 2014, 15 pages.
Abstract of WO2013128732, dated Sep. 6, 2013, 2 pages.

*Primary Examiner* — Daniel Walsh
(74) *Attorney, Agent, or Firm* — Barley Snyder

(57) ABSTRACT

A socket assembly is disclosed. The socket assembly includes a light emitting diode (LED) package having an LED printed circuit board (PCB), a base frame, an isolator frame, and an electrical contact. The base frame has a base mounted to a support structure and a spring finger extending from the base, the spring finger applying a clamping force to the LED PCB that acts in a direction toward the support structure. The isolator frame is mounted to the support structure. The electrical contact is electrically connected to the LED PCB and disposed within the isolator frame, such that the isolator frame electrically isolates the base frame from the electrical contact.

19 Claims, 18 Drawing Sheets

(51) Int. Cl.

| | |
|---|---|
| ***F21V 29/00*** | (2015.01) |
| ***F21K 9/00*** | (2016.01) |
| ***F21V 29/70*** | (2015.01) |
| ***F21V 23/02*** | (2006.01) |
| ***F21V 23/06*** | (2006.01) |
| *F21Y 115/10* | (2016.01) |

(52) U.S. Cl.

CPC ..... *F21V 19/0055* (2013.01); *F21V 23/001* (2013.01); *F21V 23/02* (2013.01); *F21V 23/06* (2013.01); *F21V 29/20* (2013.01); *F21V 29/70* (2015.01); *F21Y 2115/10* (2016.08)

(56) References Cited

U.S. PATENT DOCUMENTS 7,936,561 B1 * 5/2011 Lin ..... F21V 19/0055 165/185
8,246,204 B2 * 8/2012 McCanless ..... F21V 19/0055 362/200
8,545,047 B2 * 10/2013 Yip ..... F21V 7/0008 362/235
8,568,001 B2 * 10/2013 Daily ..... F21V 19/004 362/396
8,614,456 B2 * 12/2013 Leising ..... H01L 33/486 257/79
8,834,194 B2 * 9/2014 Sakai ..... F21V 29/22 439/345
8,926,135 B2 * 1/2015 Zaderej ..... F21K 9/00 362/249.05
9,146,027 B2 * 9/2015 Zantout ..... F21V 21/088
9,188,316 B2 * 11/2015 Daily ..... F21V 19/003
9,651,202 B2 * 5/2017 Derks ..... F21K 9/20
9,671,093 B2 * 6/2017 Liao ..... F21V 19/004
2005/0024870 A1 * 2/2005 Coushaine ..... F21K 9/00 362/249.02
2005/0180157 A1 * 8/2005 Watanabe ..... F21V 19/004 362/543
2005/0200495 A1 * 9/2005 Sibalich ..... F21S 8/02 340/693.11
2005/0243559 A1 * 11/2005 Coushaine ..... F21K 9/00 362/294
2006/0035511 A1 * 2/2006 Mrakovich ..... F21V 21/002 439/404
2006/0039159 A1 * 2/2006 Grote, III ..... B60Q 1/2696 362/548
2006/0273338 A1 * 12/2006 Lee ..... H01L 33/642 257/99
2007/0062032 A1 * 3/2007 Ter-Hovhannissian ..... H05K 1/0203 29/840
2007/0217467 A1 * 9/2007 DeFranza ..... H01S 5/024 372/50.12
2008/0106895 A1 * 5/2008 Van De Ven ..... F21K 9/62 362/231
2008/0130275 A1 * 6/2008 Higley ..... F21L 4/027 362/184
2008/0224166 A1 * 9/2008 Glovatsky ..... F21S 48/115 257/99
2008/0259608 A1 * 10/2008 Chang ..... F21K 9/00 362/307
2008/0273327 A1 * 11/2008 Wilcox ..... F21S 2/005 362/267
2009/0052199 A1 * 2/2009 Bolander, Jr. ..... B60Q 1/2607 362/509
2009/0108281 A1 * 4/2009 Keller ..... H01L 33/62 257/98
2009/0191725 A1 * 7/2009 Vogt ..... H01R 4/4818 439/56
2009/0290343 A1 * 11/2009 Brown ..... F21K 9/00 362/235
2010/0055811 A1 * 3/2010 Lin ..... H05K 1/0204 438/26
2010/0149823 A1 * 6/2010 Happoya ..... F21V 29/85 362/373
2010/0182788 A1 * 7/2010 Luo ..... F21V 29/71 362/253
2011/0089465 A1 * 4/2011 Lin ..... H01L 21/486 257/99
2011/0134634 A1 * 6/2011 Gingrich, III ..... F21V 15/01 362/231
2011/0136394 A1 * 6/2011 Mostoller ..... F21K 9/00 439/701
2011/0255280 A1 * 10/2011 Chen ..... F21L 14/00 362/235
2011/0267831 A1 * 11/2011 Daily ..... H01R 25/142 362/396
2011/0273895 A1 11/2011 Uemoto et al.
2011/0285288 A1 * 11/2011 Thrailkill ..... F21V 29/004 315/35
2012/0044681 A1 * 2/2012 Lin ..... F21K 9/00 362/235
2012/0051068 A1 * 3/2012 Pelton ..... F21V 14/04 362/373
2012/0113635 A1 * 5/2012 Sim ..... F21K 9/00 362/235
2012/0294017 A1 11/2012 Nagasaki et al.
2013/0027948 A1 * 1/2013 Gaeta ..... F21V 19/001 362/311.02
2013/0044444 A1 * 2/2013 Creighton ..... G01J 1/0271 361/752
2013/0044501 A1 * 2/2013 Rudisill ..... H05K 3/325 362/398
2013/0065419 A1 * 3/2013 Sakai ..... F21V 29/22 439/370
2013/0084748 A1 * 4/2013 Zaderej ..... F21K 9/00 439/620.02
2013/0122729 A1 * 5/2013 Daily ..... F21V 19/003 439/220
2013/0176708 A1 * 7/2013 Mostoller ..... F21V 19/0055 362/95
2013/0201701 A1 * 8/2013 Daily ..... F21V 19/004 362/396
2013/0248905 A1 * 9/2013 Lee ..... H01L 33/52 257/98
2014/0160773 A1 * 6/2014 Peters ..... F21V 23/06 362/382
2014/0179139 A1 * 6/2014 Tanaka ..... F21V 19/003 439/226
2014/0217446 A1 * 8/2014 Chang ..... H01L 33/58 257/98
2014/0369056 A1 * 12/2014 Kwon ..... F21K 9/00 362/375
2015/0055356 A1 * 2/2015 Derks ..... H01R 13/24 362/418
2015/0176831 A1 * 6/2015 Zhang ..... F21V 23/06 362/294
2016/0018093 A1 * 1/2016 Van Winkle ..... F21V 23/006 362/311.02
2016/0061423 A1 * 3/2016 Fong ..... F21K 9/23 362/363
2016/0178167 A1 * 6/2016 McGowan ..... F21V 19/003 362/382
2016/0312984 A1 * 10/2016 Poorter ..... F21V 19/0055
2016/0327248 A1 * 11/2016 Meyer ..... F21S 8/031
2016/0377266 A1 * 12/2016 Poorter ..... F21V 19/004 362/382

FOREIGN PATENT DOCUMENTS

EP 2525447 A2 11/2012
EP 2570721 A1 3/2013
EP 2623854 A2 7/2013
JP 2008-270106 A 11/2008
JP 2012-049530 A 3/2012
JP 2012-243512 A 12/2012
JP WO2011-039998 A1 2/2013
JP 2013-162127 A 8/2013

(56) References Cited

FOREIGN PATENT DOCUMENTS

| | | | |
|---|---|---|---|
| JP | 2017504162 | A | 2/2017 |
| WO | 2011088212 | A2 | 7/2011 |
| WO | 2013128732 | A1 | 9/2013 |

* cited by examiner

LED SOCKET ASSEMBLY

CROSS-REFERENCE TO RELATED APPLICATIONS

This application is a continuation of PCT International Patent Application No. PCT/EP2014/050031, filed Jan. 2, 2014.

FIELD OF THE INVENTION

The present invention relates to a light emitting diode (LED), and more particularly, to an LED lighting system.

BACKGROUND

LED lighting systems typically include one or more LED packages. The LED packages may be a "chip-on-board" (COB) LED, or may be any other type of LED package, including one or more LEDs on a printed circuit board (PCB); referred to herein as an "LED PCB".

In known LED lighting systems, the LED package is held within a recess of a socket housing that is mounted to a support structure of the lighting fixture, for example, a base or a heat sink. When the LED package is held by the socket housing, the socket housing may apply a force to the LED package to press the LED package toward the support structure. The force applied by the socket housing may hold the LED PCB in engagement with the support structure or a thermal interface material that extends between the LED PCB and the support structure. The force applied by the socket housing to the LED package, however, may cause the LED package to fail. For example, the force may be sufficiently high to fracture the LED package, or the force may be insufficient to securely hold the LED package between the socket housing and the support structure, which may allow the LED package to vibrate and thereby fracture or otherwise fail.

SUMMARY

An object of the invention, among others, is to provide a socket assembly wherein an LED package is held to a support structure without failing. The disclosed socket assembly includes a light emitting diode (LED) package having an LED printed circuit board (PCB), a base frame, an isolator frame, and an electrical contact. The base frame has a base mounted to a support structure and a spring finger extending from the base, the spring finger applying a clamping force to the LED PCB that acts in a direction toward the support structure. The isolator frame is mounted to the support structure. The electrical contact is electrically connected to the LED PCB and disposed within the isolator frame, such that the isolator frame electrically isolates the base frame from the electrical contact.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a lighting assembly. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
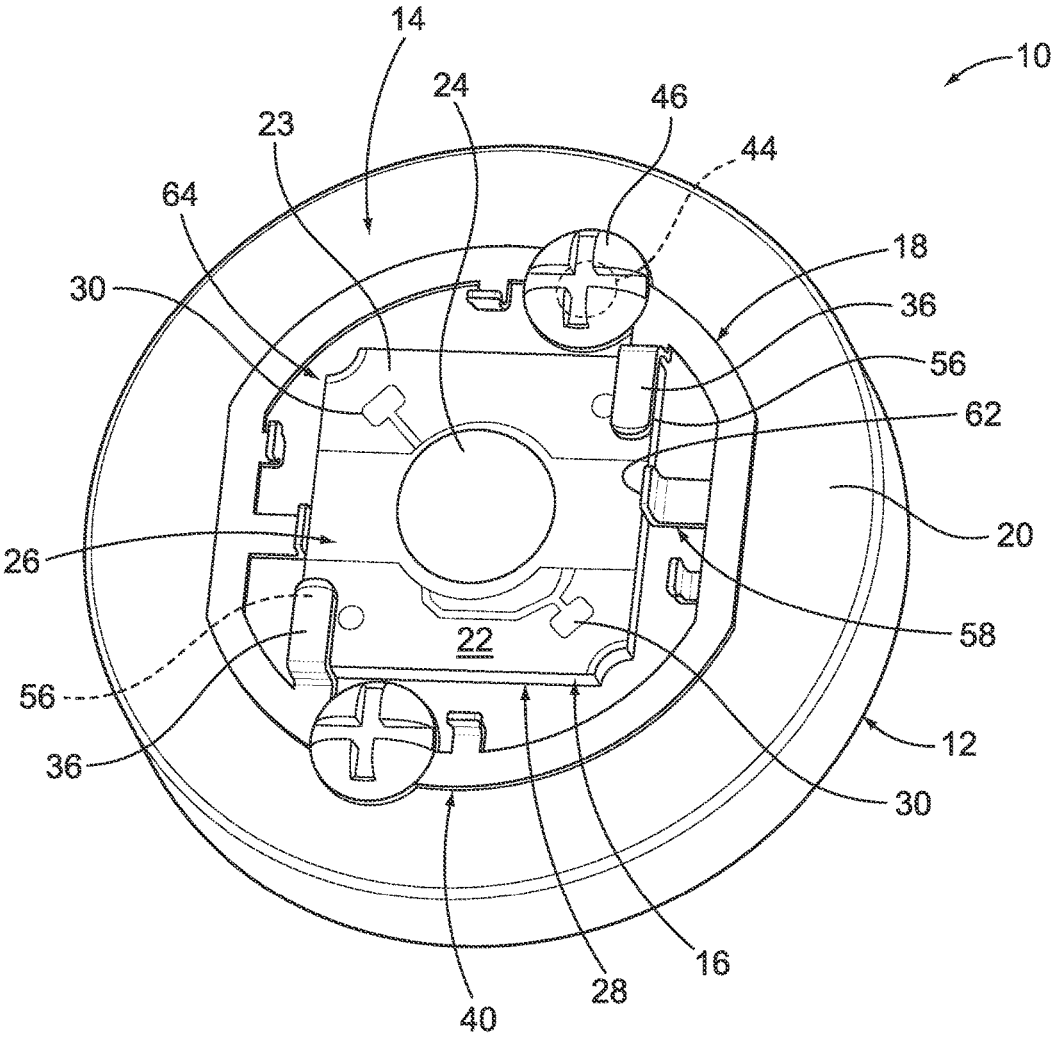
FIG. 1 is a perspective view of an embodiment of a lighting assembly.
Figure 2:
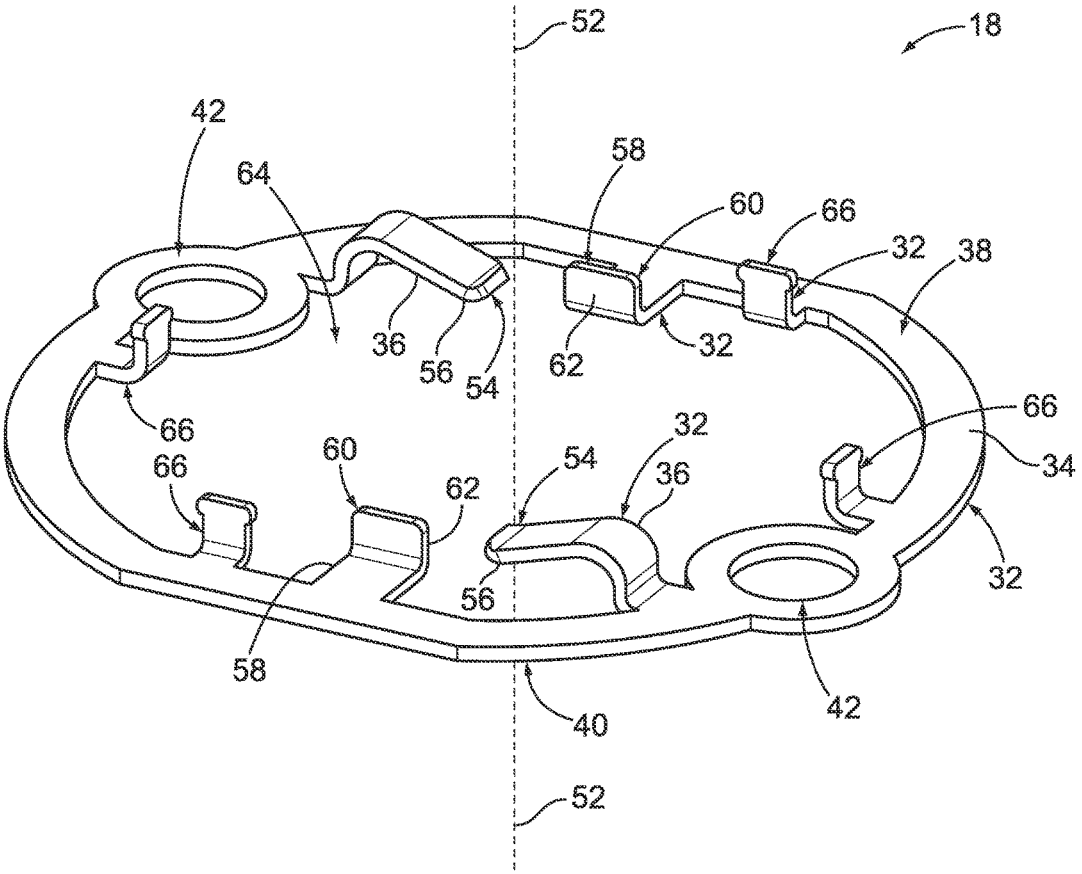
FIG. 2 is a perspective view of a clamp of the lighting assembly of FIG. 1.
Figure 3:
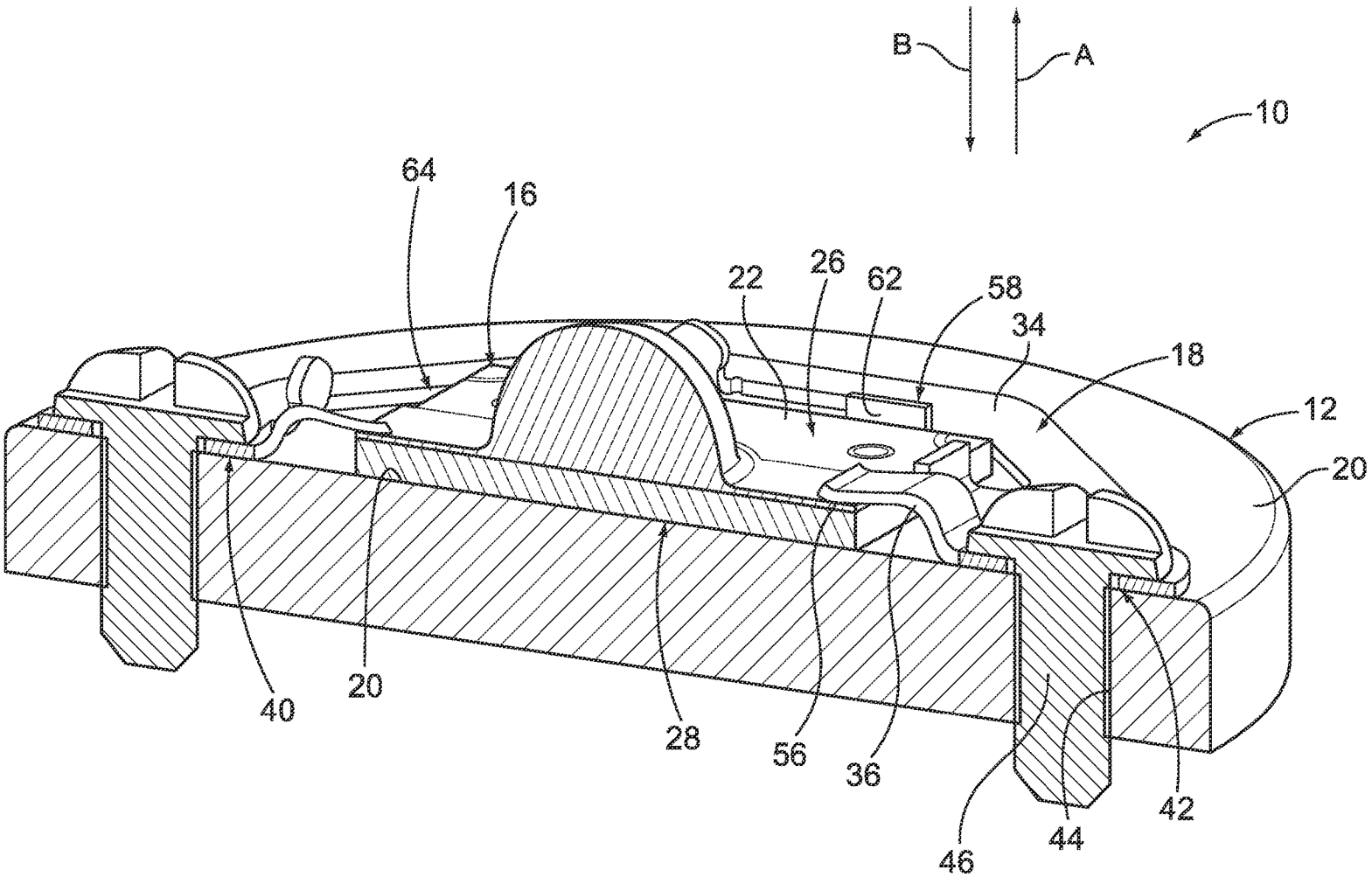
FIG. 3 is a sectional view of the lighting assembly of FIG. 1.

A lighting assembly 10 according to the invention is shown generally in FIGS. 1-3. The lighting assembly 10 includes a support structure 12 and a socket assembly 14. The lighting assembly 10 may be part of a light engine, a light fixture, or other lighting system that is used for residential, commercial, and/or industrial use. The lighting assembly 10 may be used for general purpose lighting, or alternatively, may have a customized application and/or end use.

The support structure 12 may be any structure to which the socket assembly 14 is capable of being mounted, such as, but not limited to, a base, a heat sink, and the like. The support structure 12 includes a mounting surface 20. In the shown embodiment, at least a portion of the mounting surface 20 is approximately flat. The support structure 12 may include one or more openings 44, as shown in FIGS. 1 and 3.

The socket assembly 14 includes a light emitting diode (LED) package 16 and a clamp 18. As will be described in more detail below, the clamp 18 is used to hold the LED package 16 to the support structure 12.

The LED package 16, as shown in FIG. 1, includes an LED printed circuit board (PCB) 22 with an LED 24 mounted thereto. In the shown embodiment, a single LED 24 is mounted to the LED PCB 22, however, any number of LEDs 24 may be mounted to the LED PCB 22. The LED PCB 22 may be sized appropriately depending on the number of LEDs 24 mounted thereto. The LED PCB 22 includes opposite sides 26 and 28. The LED 24 is mounted on the side 26 of the LED PCB 22. The LED package 16 includes one or more power pads 30 on the LED PCB 22.

In the embodiment shown in FIG. 1, the LED package 16 is what is commonly referred to as a "chip-on-board" (COB) LED. The LED package 16, however, may be any other type of LED package, such as, but not limited to, an LED package that includes an LED PCB and one or more LEDs soldered to the LED PCB. The LED PCB 22 shown in FIG. 1 includes a rectangular shape, however, the LED PCB 22 may additionally or alternatively include any other shape, which may depend on the type and/or number of LEDs 24 mounted to the LED PCB 22. A substrate 23 of the LED PCB 22 may be fabricated from any materials, such as, but not limited to, a ceramic, polytetrafluoroethylene, FR-4, FR-1, CEM-1, CEM-3, FR-2, FR-3, FR-5, FR-6, G-10, CEM-2, CEM-4, CEM-5, an insulated metal substrate (IMS) and/or the like.

The clamp 18 is shown in FIG. 2. The clamp 18 includes a body 32, which includes a base 34 and one or more spring fingers 36 that extend from the base 34.

The base 34 includes opposite sides 38 and 40. The base 34 extends a thickness T between the sides 38 and 40. The base 34 is configured to be mounted on the mounting surface 20 of the support structure 12; as shown in FIGS. 1 and 3, the side 40 of the base 34 engages the mounting surface 20.

The body 32 of the clamp 18 may include one or more mounting members 42 that are used to mount the clamp 18 to the support structure 12. The clamp 18 may include any number of the mounting members 42, in the embodiment shown in FIG. 2, the base 34 includes two mounting members 42. Each of the mounting members 42 may additionally or alternatively be any type of mounting member, such as, but not limited to, a post, a latch, a spring, a snap-fit member, an interference-fit member, a rivet, a pop rivet, a threaded fastener, and/or the like. Examples of other types of mounting members are described below with respect to the mounting members 242 and 342 shown in FIGS. 6 and 7, respectively.

The base 34 optionally includes a ring structure having a central axis 52. Specifically, the ring structure of the base 34 extends around the central axis 52 and the base 34 extends the thickness T along the central axis 52. The ring structure of the base 34 is configured to extend at least partially around the circumference of the LED PCB 22. As used herein, a "ring structure" means a structure that extends at least partially (e.g., may or may not be continuous) around a central axis and that includes a curved segment. As can be seen in FIG. 2, in the exemplary embodiment, the ring structure of the base 34 is a continuous structure that extends completely around the central axis 52. In an alternative embodiment, the ring structure of the base 34 is not a continuous structure such that the ring structure of the base 34 extends only partially around the central axis 52. The ring structure of the base 34 shown in FIG. 2 includes curved segments and straight segments. Alternatively, the ring structure of the base 34 may be a single curved segment, or further may be a circular shape, an oval shape, an elliptical shape, and/or the like. The base 34 is not limited to having a ring structure, but rather may additionally or alternatively include any other shape that enables the clamp 18 to function as described and/or illustrated herein. Examples of other shapes of the base 34 include, but are not limited to, a rectangular shape, a square shape, a quadrilateral shape, a shape having two or more sides, and/or the like. The size and/or shape of the base 34, and/or other components of the clamp 18, may depend on the size and/or shape of one or more components of the LED package 16.

Each spring finger 36 is a resiliently deflectable spring extending from the ring structure of the base 34 in a radially inward direction relative to the central axis 52. Each spring finger 36 extends a length from the base 34 to an end 54 and includes an interface 56 at which the spring finger 36 is configured to engage the LED PCB 22. In the exemplary embodiment, the end 54 of each spring finger 36 includes the corresponding interface 56, but each interface 56 may alternatively extend at any other location along the length of the corresponding spring finger 36. Although two are shown, the clamp body 32 may include any number of the spring fingers 36. Parameters of the spring fingers 36 include, but are not limited to, the number of spring fingers 36, the geometry (e.g., shape) of each of the spring fingers 36, the dimensions (e.g., length, width, thickness, and/or the like) of each of the spring fingers 36, the location of each of the spring fingers 36 along the base 34, the orientation of each of the spring fingers 36 relative to the base 34, the materials of each of the spring fingers 36, and/or the like. The various parameters of the spring fingers 36 may be selected to provide a predetermined clamping force, as is discussed in greater detail below.

The body 32 of the clamp 18 may include one or more of the locating members 58. The clamp 18 may include any number of the locating members 58, each of which may be any type of locating member. In the embodiment shown in FIG. 2, the locating members 58 are extensions that extend from the ring structure of the base 34 in a radially inward direction relative to the central axis 52. Each locating member 58 extends a length from the base 34 to an end 60. The locating members 58 include interfaces 62. The recess 64 of the clamp body 32 is defined between the interfaces 62. In the embodiment shown in FIG. 2, the end 60 of each locating member 58 includes the interface 62, but each interface 62 may alternatively extend at any other location along the length of the corresponding locating member 58. In addition or alternatively to the extensions, one or more other types of locating members 58 may be provided.

The body 32 of the clamp 18 may includes one or more retention members 66 that are configured to mechanically connect the body 32 of the clamp 18 to a housing. The clamp 18 may include any number of the retention members 66, each of which may be any type of retention member. In the exemplary embodiment, the retention members 66 are interference-fit tabs that extend from the base 34 outwardly relative to the side 38 of the base 34. Although four are shown, the body 32 of the clamp 18 may include any number of the retention members 66. Moreover, each of the retention members 66 may additionally or alternatively be any other type of retention member, such as, but not limited to, a post, a latch, a spring, a snap-fit member, another type of interference-fit member, an opening, and/or the like. In some embodiments, in addition or alternative to the retention members 66, one or more of the mounting members 42 may be used to mechanically connect the body 32 of the clamp 18 to a housing.

In some embodiments, the spring fingers 36 extend from the base 34 such that the base 34 and the spring fingers 36 define a unitary body of the clamp 18. In some embodiments, the mounting members 42, the locating members 58, and/or the retention members 66 define a unitary body with the base 34. The unitary body defined by the base 34 and the spring fingers 36 may constitute an approximate entirety of the body 32 of the clamp 18, or the unitary body defined by the base 34 and the spring fingers 36 may constitute only a portion of the clamp body 32. For example, the unitary body defined by the base 34 and the spring fingers 36 may constitute an approximate entirety of the body 32 of the clamp 18 when the mounting members 42, the locating members 58, and the retention members 66 also define a unitary body with the base 34. In such embodiments wherein the mounting members 42, the locating members 58, the retention members 66, and the spring fingers 36 define a unitary body with the base 34, the body 32 of the clamp 18 is a one-piece body. Moreover, and for example, the unitary body defined by the base 34 and the spring fingers 36 may constitute only a portion of the body 32 of the clamp 18 when the mounting members 42, the locating members 58, and/or the retention members 66 do not define a unitary body with the base 34.

As used herein, two or more items define a "unitary body" when the items are formed as a single continuous structure. In some embodiments, two or more items are considered to be formed as a single continuous structure if the items are incapable of being separated without damaging (such as, but not limited to, cutting through, breaking, melting, and/or the like) at least one of the items and/or a fastener that joins the items together. One example of items that are formed as a single continuous structure is two items that are integrally formed (e.g., formed from the same stamp of a sheet or reel of material). Another example of items that are formed as a single continuous structure is two items that are mechanically joined together after formation of both of the items using a mechanical fastener (e.g., an adhesive, a weld, a solder joint, and/or the like) that joins the items together such that the items are incapable of being separated without damaging at least one of the items and/or the mechanical fastener. One example of items that are not formed as a single continuous structure is two items that are mechanically joined together after formation of both of the items using a mechanical fastener (e.g., a threaded fastener, a clip, a clamp, and/or the like) that joins the items together such that the items are capable of being separated without damaging the items and the mechanical fastener.

The body 32 of the clamp 18 may be fabricated using any method, process, structure, means, and/or the like, such as, but not limited to, using a cutting process, using a casting process, using a molding process, using a forming process, and/or the like. Cutting processes include, but are not limited to, water cutting, stamping, laser cutting, punching, cutting using a saw, drill bit, plane, mill, and/or other solid cutting tool, and/or the like. Forming processes include, but are not limited to, drawing, bending, and/or the like. When the body 32 of the clamp 18 is fabricated using a cutting process, the body 32 may be cut from a reel of material, from a blank of material, from an approximately flat sheet of material, from an approximately flat material, from a rod of material, and/or the like. In some embodiments, the body 32 of the clamp 18 is a cut and formed body that is cut from a material and then formed to include the finished shape of the body 32. Moreover, in some embodiments, the spring fingers 36, the mounting members 42, the locating members 58, and/or the retention members 66 are integrally formed with the base 34.

The body 32 of the clamp 18 may be fabricated from any material that enables the clamp 18 to function as described and/or illustrated herein. In some embodiments, the body 32 of the clamp 18 is metallic (e.g., one or more of the various components of the body 32 includes a metal and/or a material that exhibits similar properties to a metal). The various components of the clamp body 32 such as the base 34, the mounting members 42, the locating members 58, the retention members 66, and/or the spring fingers 36 may be fabricated from the same and/or different materials than each other. In some embodiments, the body 32 of the clamp 18 includes a material that is a relatively good thermal conductor, such that the clamp body 32 facilitates transferring heat from the LED package 16 to the support structure 12.

The assembled lighting assembly 10 is shown in FIGS. 1 and 3.

The clamp 18 is mounted to the support structure 12 such that the clamp 18 holds the LED package 16 to the support structure 12. Specifically, the base 34 of the clamp 18 is mounted to the support structure 12 using the mounting members 42 of the clamp 18. The fasteners 46 are threaded fasteners that are received through the openings of the mounting members 42 and into the openings 44 within the support structure 12. In the exemplary embodiment, the openings 44 of the support structure 12 are threaded, such that the fasteners 46 threadably connect to the support structure 12. In addition or alternatively, a nut (not shown) is used to secure the fasteners 46 within the openings 44. When the clamp 18 is mounted to the support structure 12, the base 34 engages the support structure 12. Specifically, the side 40 of the base 34 is engaged with the mounting surface 20 of the support structure 12.

The LED package 16 is received within the recess 64 of the clamp 18 such that the interfaces 62 of the locating members 58 are engaged with the LED PCB 22. The locating members 58 may center the LED PCB 22 within the recess 64 and provide anti-rotational features that prevent rotation of the LED package 16 relative to the clamp body 32. The spring fingers 36 of the clamp 18 are engaged with the LED package 16 such that the LED PCB 22 is clamped between the spring fingers 36 and the support structure 12. Specifically, the interfaces 56 of the spring fingers 36 are engaged with the side 26 of the LED PCB 22 such that the spring fingers 36 are deflected in a direction away from the support structure 12, an example of which is represented by the arrow A shown in FIG. 3. In the deflected positions shown in FIGS. 1 and 3, the spring fingers 36 exert the clamping force on the side 26 of the LED PCB 22 that acts in a direction toward the support structure 12, an example of which is represented by the arrow B.

The clamp 18 thus holds the LED package 16 to the support structure 12. The clamping force, or a range thereof, may be selected to facilitate preventing failure of the LED package 16. The clamping force may be sufficiently low to prevent the LED PCB 22 from fracturing (e.g., cracking, breaking, and/or the like), and may be sufficiently high to securely hold the LED package 16 between the clamp 18 and the support structure 12 in a manner that prevents the LED package 16 from vibrating.

In the embodiment shown in FIG. 3, the side 28 of the LED PCB 22 is engaged with the mounting surface 20 of the support structure 12 when the LED package 16 is held to the support structure 12 by the clamp 18. In addition or alternatively, when the LED package 16 is held to the support structure by the clamp 18, the side 28 of the LED PCB 22 may engage an intermediate member (e.g., a thermal interface material; not shown) that extends between the LED PCB 22 and the support structure 12. The engagement between the LED PCB 22 and the support structure 12 and/or intermediate member may facilitate the transfer of heat away from the LED package 16.

The power pads 30 of the LED package 16 are configured to be soldered or otherwise electrically connected to corresponding electrical wires (not shown). The electrical wires supply electrical power to the LED package 16 to drive operation of the LED 24.

Figure 4:
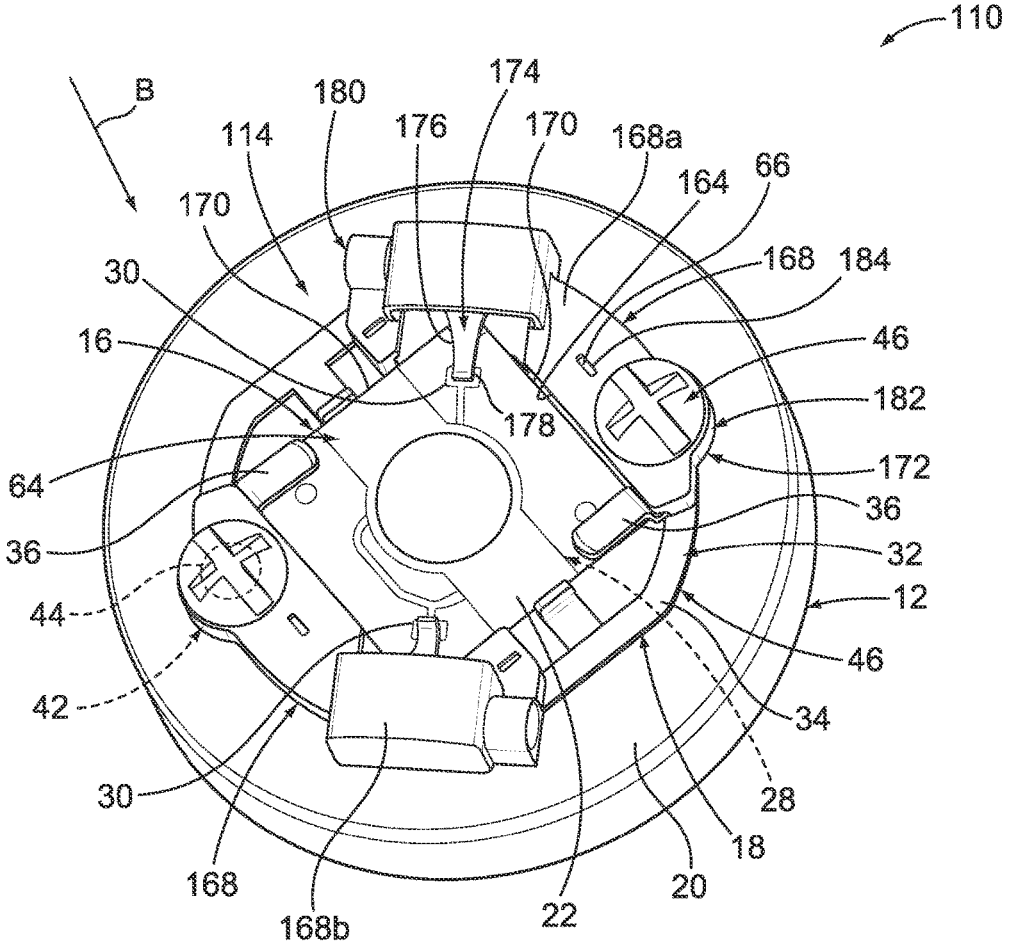
FIG. 4 is a perspective view of another embodiment of a lighting assembly.
Figure 5:
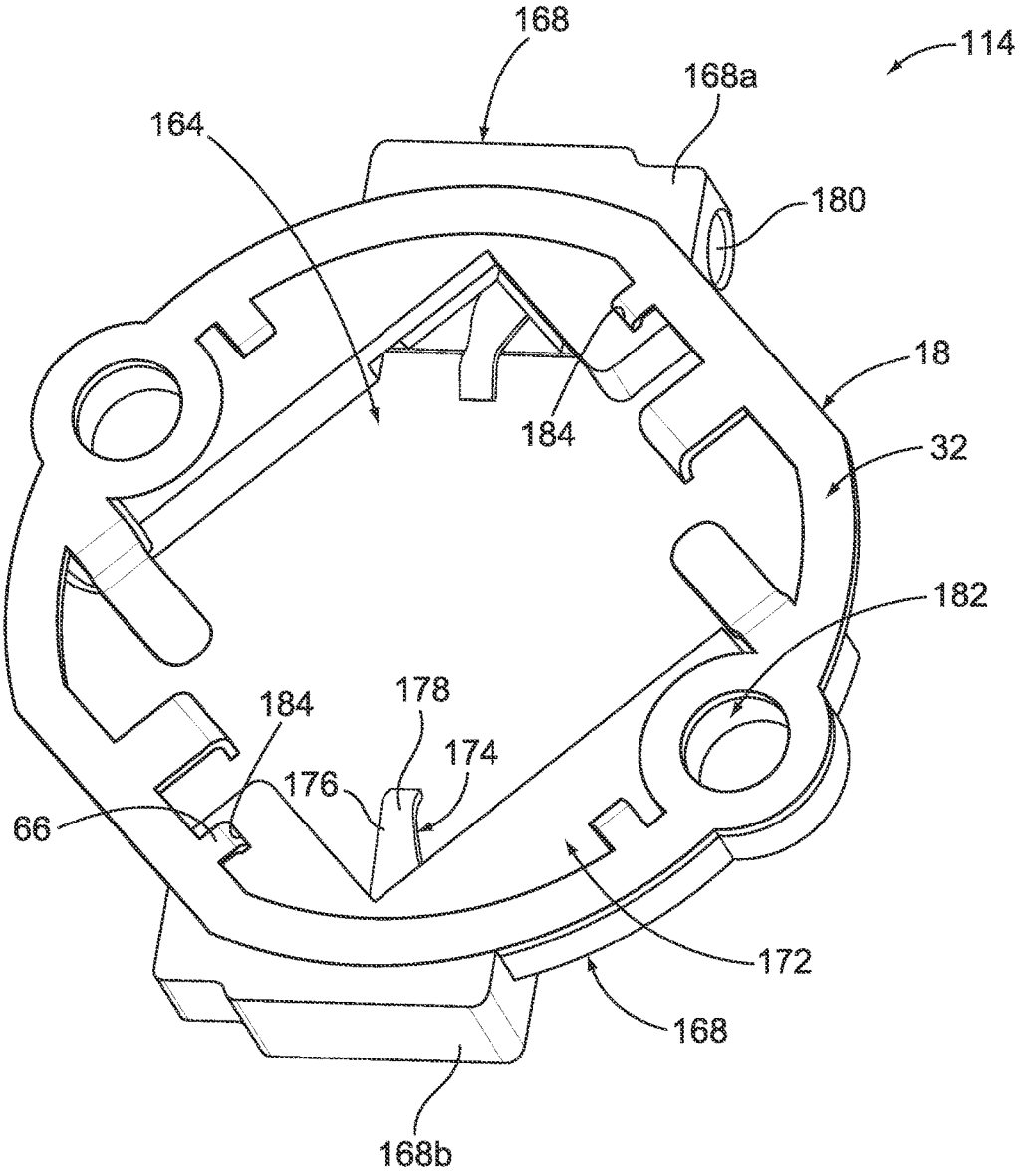
FIG. 5 is a perspective view of a socket assembly of the lighting assembly of FIG. 4.

A lighting assembly 110 according to another embodiment of the invention is shown in FIGS. 4 and 5. In this embodiment and throughout the embodiments disclosed, like reference numbers indicate like elements. The lighting assembly 110 includes the support structure 12 and a socket assembly 114, which is mounted to the support structure 12. The socket assembly 114 includes the LED package 16 and the clamp 18 as disclosed in FIGS. 1-3 above, and further includes a housing 168.

The socket assembly 114 is shown in FIG. 5. The housing 168 of the socket assembly 114 includes a recess 164 that receives the LED package 16 therein. In the exemplary embodiment, the housing 168 includes two or more discrete housing segments 168*a* and 168*b* that cooperate to define the recess 164. Specifically, the recess 164 is defined between the housing segments 168*a* and 168*b*. In some alternative embodiments, the housing 168 includes a single continuous housing segment instead of the two or more discrete housing segments 168*a* and 168*b*. For example, the housing segments 168*a* and 168*b* may be fabricated as a single unitary body. Moreover, although two are shown, the housing 168 may include any number of discrete housing segments greater than two. The size and/or shape of the housing 168, including any housing segments thereof, may depend on the size and/or shape of one or more components of the LED package 16.

In the embodiment shown in FIG. 5, the housing segments 168*a* and 168*b* do not engage each other. In an alternative embodiment, the housing segments 168*a* and/or 168*b* may engage each other. Optionally, the housing segments 168*a* and 168*b* are substantially identical and/or hermaphroditic. For example, the housing segments 168*a* and 168*b* are optionally fabricated using one or more of the same molds.

Each housing segment 168*a* and 168*b* includes a mounting side 172 along which the housing segments 168*a* and 168*b* are configured to be mounted to the support structure 12. In the exemplary embodiment, the housing segments 168*a* and 168*b* each include an L-shape. But, the housing segments 168*a* and 168*b* may additionally or alternatively include any other shapes, which may depend on the shape of one or more components of the LED package 16.

The housing segments 168*a* and 168*b* hold power contacts 174. The power contacts 174 include fingers 176 that extend outwardly from the housing segments 168*a* and 168*b* into the recess 164. The fingers 176 include mating interfaces 178. Each power contact 174 may include any number of the fingers 176, and each housing segment 168*a* and 168*b* may hold any number of the power contacts 174.

Each housing segment 168*a* and 168*b* includes one or more wire slots 180 that receive an electrical wire 181 therein. When an electrical wire 181 is received within the wire slot 180, an electrical conductor 183 of the electrical wire 181 engages the power contact 174 to establish an electrical connection between the electrical wire 181 and the power contact 174. The electrical wires 181 supply electrical power to the LED package 16 to drive operation of the LED 24. Each housing segment 168*a* and 168*b* may include any number of the wire slots 180.

Each power contact 174 includes a contact (not shown) wherein a stripped end of an electrical wire is inserted into the power contact 174 to establish an electrical connection between the electrical wire and the power contact 174. Any other type of mechanical connection may additionally or alternatively be used to establish the electrical connection between each power contact 174 and an electrical wire. For example, a power contact 174 may include an insulation displacement contact (IDC; not shown) that pierces the insulation of an electrical wire to electrically connect to an electrical conductor of the wire. Moreover, and for example, a power contact 174 may be crimped, welded, and/or otherwise electrically connected to the electrical conductor of an electrical wire.

The housing segments 168*a* and 168*b* may include one or more mounting members 182 for mounting the housing 168 to the support structure 12 and/or for mechanically connecting the housing 168 to a neighboring socket assembly (not shown). In the exemplary embodiment, the mounting members 182 are openings that are configured to receive a fastener therethrough. Each mounting member 182 may additionally or alternatively be any other type of mounting member, such as, but not limited to, a post, a latch, a spring, a snap-fit member, an interference-fit member, and/or the like. Each housing segment 168*a* and 168*b* may include any number of the mounting members 182, and the housing 168 may include any number of the mounting members 182 overall.

The housing 168 may include one or more retention features 184, in the shown embodiment, each of the housing segments 168*a* and 168*b* includes one or more of the retention features 184. But, each housing segment 168*a* and 168*b* may include any number of the retention features 184. The housing 168 may further include any number of the retention features 184 overall.

Each of the retention features 184 may be any type of retention feature. In the exemplary embodiment, the retention features 184 are openings, however, each of the retention features 184 may additionally or alternatively be any other type of retention feature, such as, but not limited to, a post, a latch, a spring, a snap-fit member, an interference-fit tab, and/or the like. The socket assembly 114 is shown assembled and mounted to the support structure 12 in FIG. 4.

The clamp 18 and the housing 168 are mounted to the support structure 12. In the embodiment shown in FIG. 4, the openings 44 of the support structure 12 are common to both the clamp 18 and the housing 168. Accordingly, the fasteners 46 are used to mount both the housing 168 and the clamp 18 to the support structure 12. Specifically, the mounting members 42 of the clamp 18 are aligned with the mounting members 182 of the housing 168 such that the fasteners 46 extend through both the openings of the mounting members 42 and the openings of the mounting members 182. Alternatively, the mounting features of the support structure 12 are not common to both the clamp 18 and the housing 168. For example, in some alternative embodiments, the mounting members 42 of the clamp 18 are not aligned with the mounting members 182 of the housing 168 such that the clamp 18 and the housing 168 are separately mounted to the support structure 12.

The clamp 18 may be mechanically connected to the housing 168. Specifically, the retention members 66 of the clamp 18 cooperate with the retention features 184 of the housing 168 to mechanically interconnect the clamp 18 and the housing 168. In the exemplary embodiment, the tabs of the retention members 66 are received within the openings of the retention features 184 with an interference-fit to mechanically interconnect the clamp 18 to the housing 168. Other arrangements may additionally or alternatively be provided to mechanically interconnect the clamp 18 and the housing 168.

As shown in FIG. 4, the LED package 16 is received within the recesses 64 and 164 of the clamp 18 and the housing 168, respectively. The housing segments 168*a* and/or 168*b* may engage one or more edge surfaces 170 of the LED PCB 22 when the LED package 16 is received within the recess 164. The power contacts 174 that are held by the housing 168 are engaged with corresponding power pads 30 of the LED PCB 22 at mating interfaces 178.

The clamp 18 holds the LED package 16 to the support structure 12. When the clamp 18 is mounted to the support structure 12 as shown in FIG. 4, the base 34 may engage the support structure 12. Specifically, the side 40 of the base 34 may be engaged with the mounting surface 20 of the support structure 12.

The spring fingers 36 of the clamp 18 are engaged with the LED package 16 such that the LED PCB 22 is clamped between the spring fingers 36 and the support structure 12. In the deflected positions shown in FIG. 4, the spring fingers 36 exert the clamping force on the side 26 of the LED PCB 22 that acts in a direction toward the support structure 12, an example of which is represented by the arrow B. The clamp 18 thus holds the LED package 16 to the support structure 12. The clamping force, or a range thereof, may be selected to facilitate preventing failure of the LED package 16. The clamping force may be sufficiently low to prevent the LED PCB 22 from fracturing (e.g., cracking, breaking, and/or the like), and may be sufficiently high to securely hold the LED package 16 between the clamp 18 and the support structure 12 in a manner that prevents the LED package 16 from vibrating.

The clamp 18 may clamp the LED PCB 22 to the support structure 12 independently of the housing 168. For example, the housing 168 may not apply a clamping force to the LED package 16 that acts in a direction toward the support structure 12. In some embodiments, the housing 168 does not exert any force on the LED package 16, or the only forces exerted by the housing 168 on the LED package 16 act on the LED package 16 in a direction that is approximately perpendicular to the direction of the arrow B and/or in a direction that is away from the support structure 12. In embodiments wherein the clamp 18 clamps the LED PCB 22 to the support structure 12 independently of the housing 168, the mounting arrangement between the housing 168 and the support structure 12 does not cause the housing 168 to apply a clamping force to the LED package 16 that acts in a direction toward the support structure 12.

In the embodiment shown in FIGS. 4 and 5, the side 28 of the LED PCB 22 is engaged with the mounting surface 20 of the support structure 12 when the LED package 16 is held to the support structure 12 by the clamp 18. In addition or alternatively, when the LED package 16 is held to the support structure by the clamp 18, the side 28 of the LED PCB 22 may engage an intermediate member (e.g., a thermal interface material; not shown) that extends between the LED PCB 22 and the support structure 12. The engagement between the LED PCB 22 and the support structure 12 and/or intermediate member may facilitate the transfer of heat away from the LED package 16.

Figure 6:
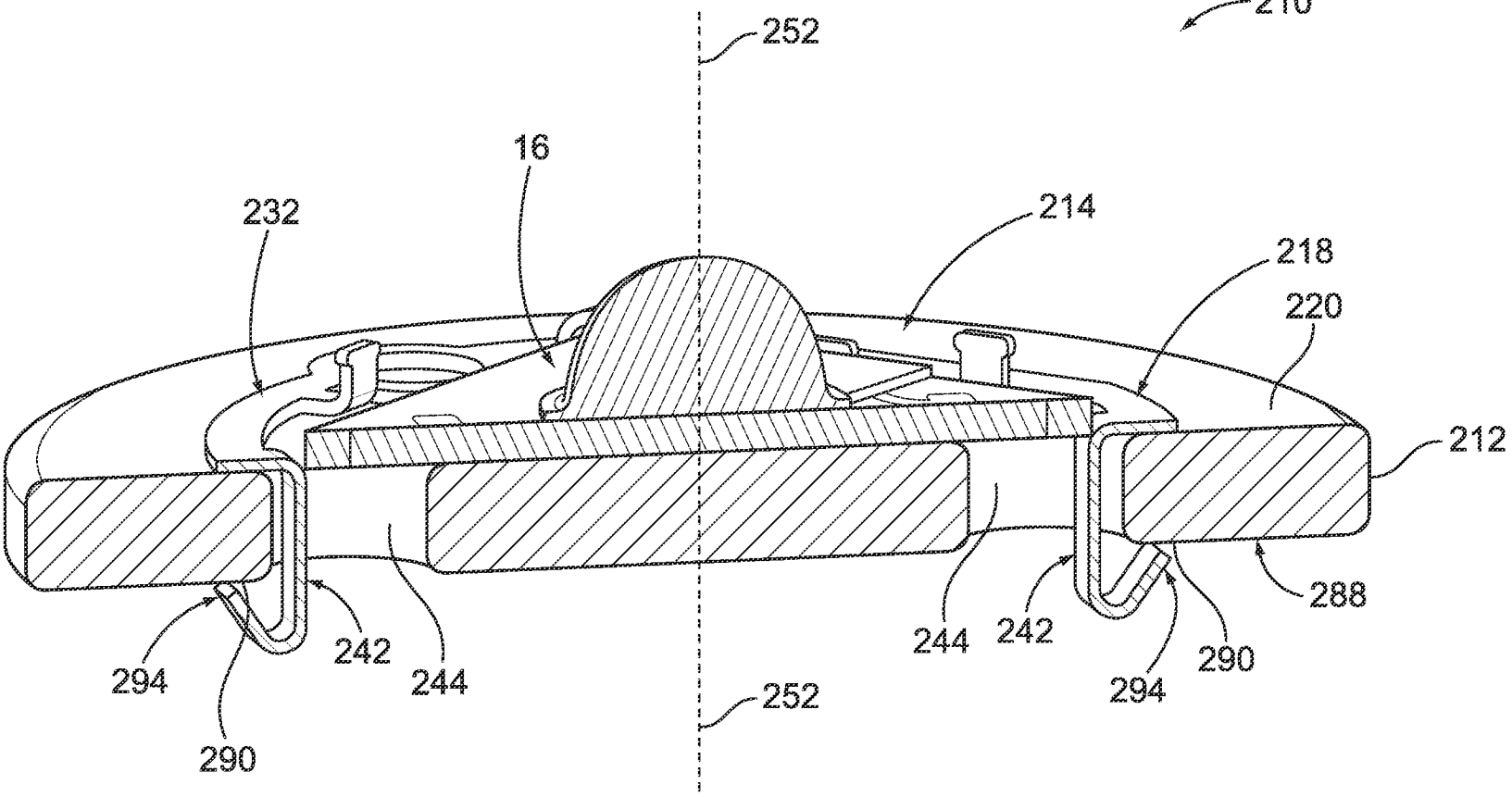
FIG. 6 is a sectional view of another embodiment of a lighting assembly.

A lighting assembly 210 according to another embodiment of the invention is shown in FIG. 6. The lighting assembly 210 in particular has another embodiment of a clamp 218. The lighting assembly 210 includes a support structure 212 and a socket assembly 214 that is mounted to the support structure 212. The socket assembly 214 includes the LED package 16 and the clamp 218.

The support structure 212, as shown in FIG. 6, includes a mounting surface 220 and an opposite side 288. The support structure 212 includes one or more openings 244, which extend through the support structure 212. The openings 244 also include segments 290 of the side 288 that extend adjacent the openings 244. The support structure 212 may include any number of openings 244.

The clamp 218 includes a body 232 having one or more springs 242, which are used to mount the clamp 218 to the support structure 212. The springs 242 are received through the openings 244 of the support structure 212, and ends 294 of the springs 242 deflect radially inward (relative to a central axis 252 of the clamp body 232) via engagement with the support structure 212. Once the ends 294 of the springs 242 have cleared the side 288 of the support structure 212, the ends 294 of the springs 242 snap radially outward (relative to the central axis 252) over the segments 290 of the support structure side 288. Engagement between the ends 294 of the springs 242 and the segments 290 holds the clamp 18 to the support structure 212. The clamp 218 may include any number of springs 242.

Figure 7:
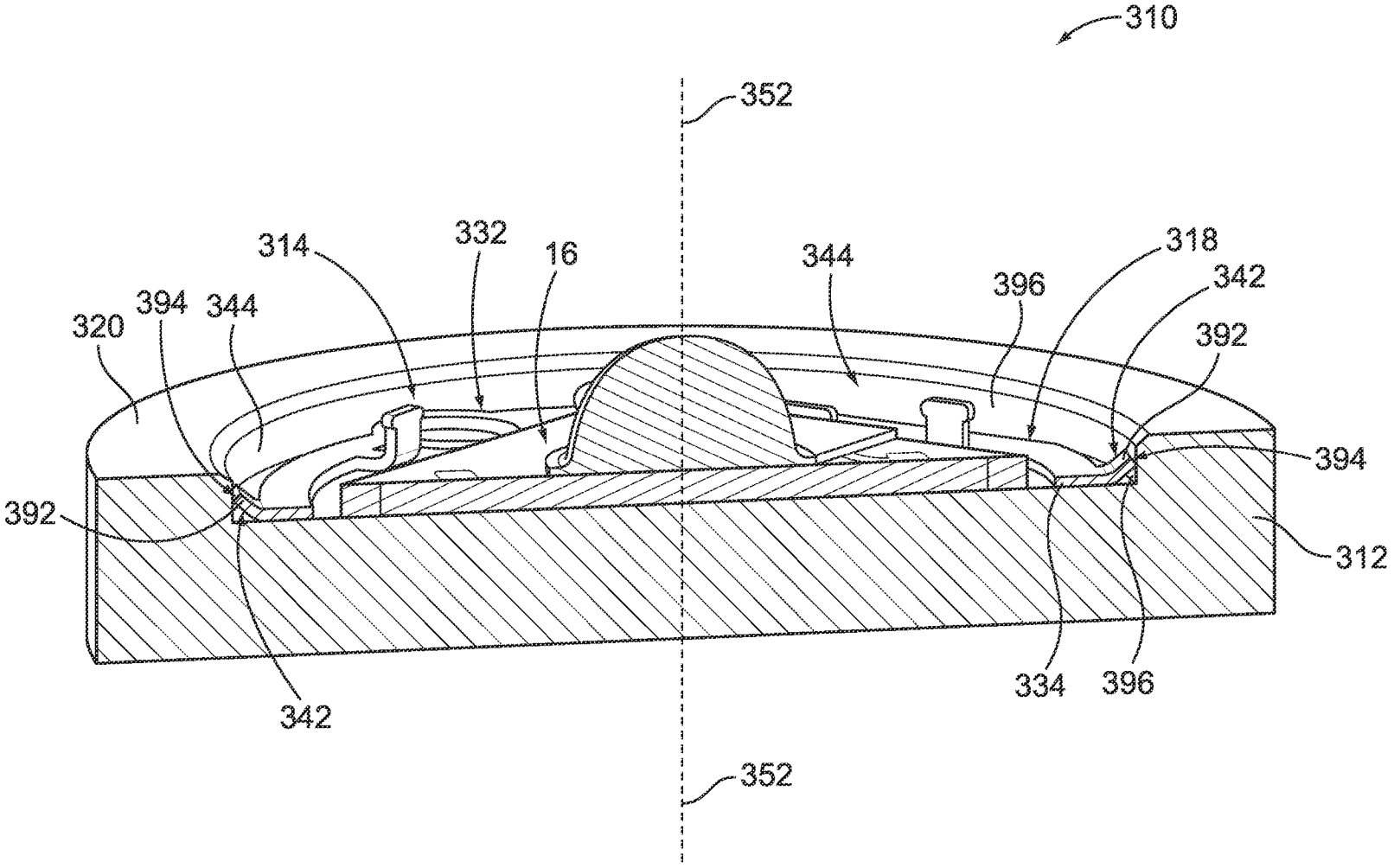
FIG. 7 is a sectional view of another embodiment of a lighting assembly.

A lighting assembly 310 according to another embodiment of the invention is shown in FIG. 7. The lighting assembly 310 in particular has another embodiment of a clamp 318. The lighting assembly 310 includes a support structure 312 and a socket assembly 314 that is mounted to the support structure 312. The socket assembly 314 includes the LED package 16 and the clamp 318.

The support structure 312 includes a mounting surface 320 and one or more recesses 344. The recess 344 extends into the mounting surface 320 of the support structure 312. The support structure 312 may include any number of recesses 344.

The clamp 318 includes a body 332 having a base 334 and one or more of the mounting members 342. The mounting members 342 are used to mount the clamp 318 to the support structure 312. In the embodiment shown in FIG. 7, the mounting members 342 include tabs 392 that extend radially outward (relative to a central axis 352 of the clamp 318) from the base 334. The tabs 392 are configured to cooperate with the recess 344 of the support structure 312 with an interference-fit connection. Specifically, as the clamp body 332 is received into the recess 344 of the support structure 312, ends 394 of the tabs 392 engage a wall 396 of the recess 344 with an interference-fit to hold the clamp 318 to the support structure 312. The clamp 318 may include any number of the mounting members 342.

A lighting assembly 410 according to another embodiment is shown in FIGS. 8-18. The lighting assembly 410 includes a support structure 412 and a socket assembly 414 that is mounted to the support structure 412. The socket assembly 414 includes a light emitting diode (LED) package 416, a metal base frame 418, an isolator frame 419, an electrical contact member 421, and a cover 425.

The support structure 412 may be any structure to which the socket assembly 414 is capable of being mounted to, such as, but not limited to, a base, a heat sink, a heat exchanger, and/or the like. In the exemplary embodiment, the support structure 412 is a heat sink. The support structure 412 includes a mounting surface 420 to which the socket assembly 414 is mounted. Optionally, at least a portion of the mounting surface 420 is approximately flat. The support structure 412 may include one or more openings 444 that are substantially similar to the openings 244 and segments 290 shown in FIG. 6, and a recess that is substantially similar to the recess 344 shown in FIG. 7.

The LED package 416 includes an LED PCB 422 with an LED 424 mounted thereto. In the exemplary embodiment, a single LED 424 is mounted to the LED PCB 422, however, any number of LEDs 424 may be mounted to the LED PCB 422. The LED PCB 422 may be sized appropriately depending on the number of LEDs 424 mounted thereto. The LED PCB 422 includes opposite sides 426 and 428. The LED 424 is mounted on the side 426 of the LED PCB 422. The LED package 416 includes one or more power pads 430 on the LED PCB 422. Each power pad 430 may be referred to herein as an "electrical power contact" of the LED PCB 422.

In the shown embodiment, the LED package 416 is what is commonly referred to as a COB LED. The LED package 416, however, may be any other type of LED package, such as an LED package that includes an LED PCB and one or more LEDs soldered to the LED PCB. The LED PCB 422 has a rectangular shape in the shown embodiment, however, the LED PCB 422 may additionally or alternatively include any other shape, which may depend on the type and/or number of LEDs 424 mounted to the LED PCB 422. A substrate 423 of the LED PCB 422 may be fabricated from any materials, such as, but not limited to, a ceramic, polytetrafluoroethylene, FR-4, FR-1, CEM-1, CEM-3, FR-2, FR-3, FR-5, FR-6, G-10, CEM-2, CEM-4, CEM-5, an insulated metal substrate (IMS) and/or the like.

Figure 9:
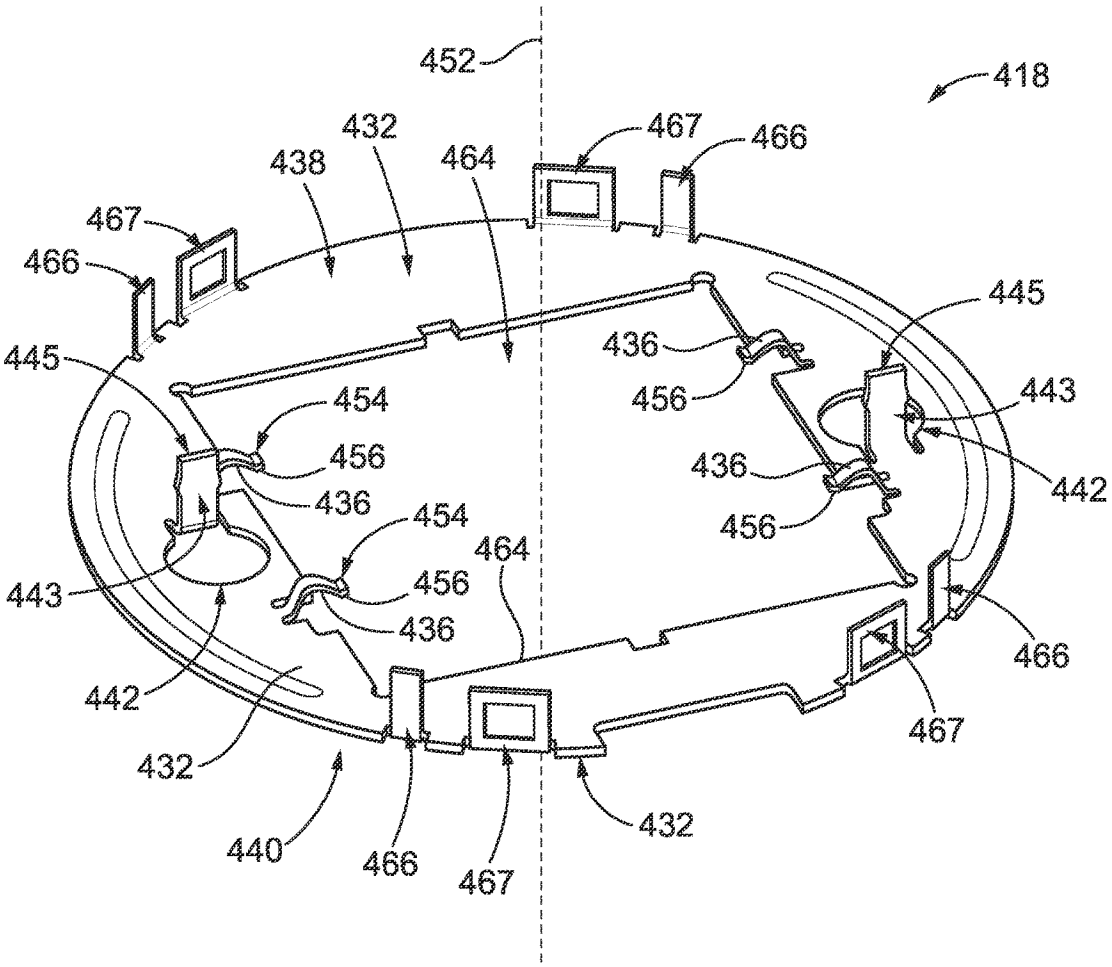
FIG. 9 is a perspective view of a base frame of the lighting assembly of FIG. 8.

The base frame 418 is shown in FIG. 9. The base frame 418 includes a body 432, which includes a base 434 and one or more spring fingers 436 that extend from the base 434. The base 434 includes opposite sides 438 and 440. The base 434 extends a thickness from the side 438 to the side 440. The body 432 includes one or more mounting members 442, which may be any type of mounting member. In the exemplary embodiment, the base 434 includes two mounting members 442, which are openings that are configured to receive a fastener therethrough. Each of the mounting members 442 may additionally or alternatively be any other type of mounting member, such as, but not limited to, a post, a latch, a spring, a snap-fit member, an interference-fit member, a rivet, a pop rivet, a threaded fastener, and/or the like.

The body 432 of the base frame 418 includes one or more optional anvils 443 that extend outward from the base 434. Each anvil 443 extends outward from the base 434 along a central axis 452 of the base 434 to an end 445. Although two are shown, the base frame 418 may include any number of the anvils 443.

The base 434 optionally includes a ring structure having the central axis 452. Specifically, the ring structure of the base 434 extends around the central axis 452 and the base 434 extends the thickness along the central axis 452. In the exemplary embodiment, the ring structure of the base 434 is a continuous structure that extends completely around the central axis 452. Alternatively, the ring structure of the base 434 may extend only partially around the central axis 452. The base 434 is not limited to having a ring structure, but rather may additionally or alternatively include any other shape, such as a rectangular shape, a square shape, a quadrilateral shape, a shape having two or more sides, and/or the like. The size and/or shape of the base 434, and/or other components of the base frame 418, may depend on the size and/or shape of one or more components of the LED package 416.

The body 432 of the base frame 418 includes the spring fingers 436. Although two are shown, the body 432 may include any number of the spring fingers 436. Each spring finger 436 extends from the ring structure of the base 434 in a radially inward direction relative to the central axis 452. Each spring finger 436 extends a length from the base 434 to an end 454 and includes an interface 456 at which the spring finger 436 is configured to engage the LED PCB 422. In the exemplary embodiment, the end 454 of each spring finger 436 includes the corresponding interface 456, but each interface 456 may alternatively extend at any other location along the length of the corresponding spring finger 436.

Parameters of the spring fingers 36 include, but are not limited to, the number of spring fingers 436, the geometry (e.g., shape) of each of the spring fingers 436, the dimensions (e.g., length, width, thickness, and/or the like) of each of the spring fingers 436, the location of each of the spring fingers 436 along the base 434, the orientation of each of the spring fingers 436 relative to the base 34, the materials of each of the spring fingers 436, and/or the like. The various parameters of the spring fingers 436 may be selected to provide a predetermined clamping force.

Figure 8:
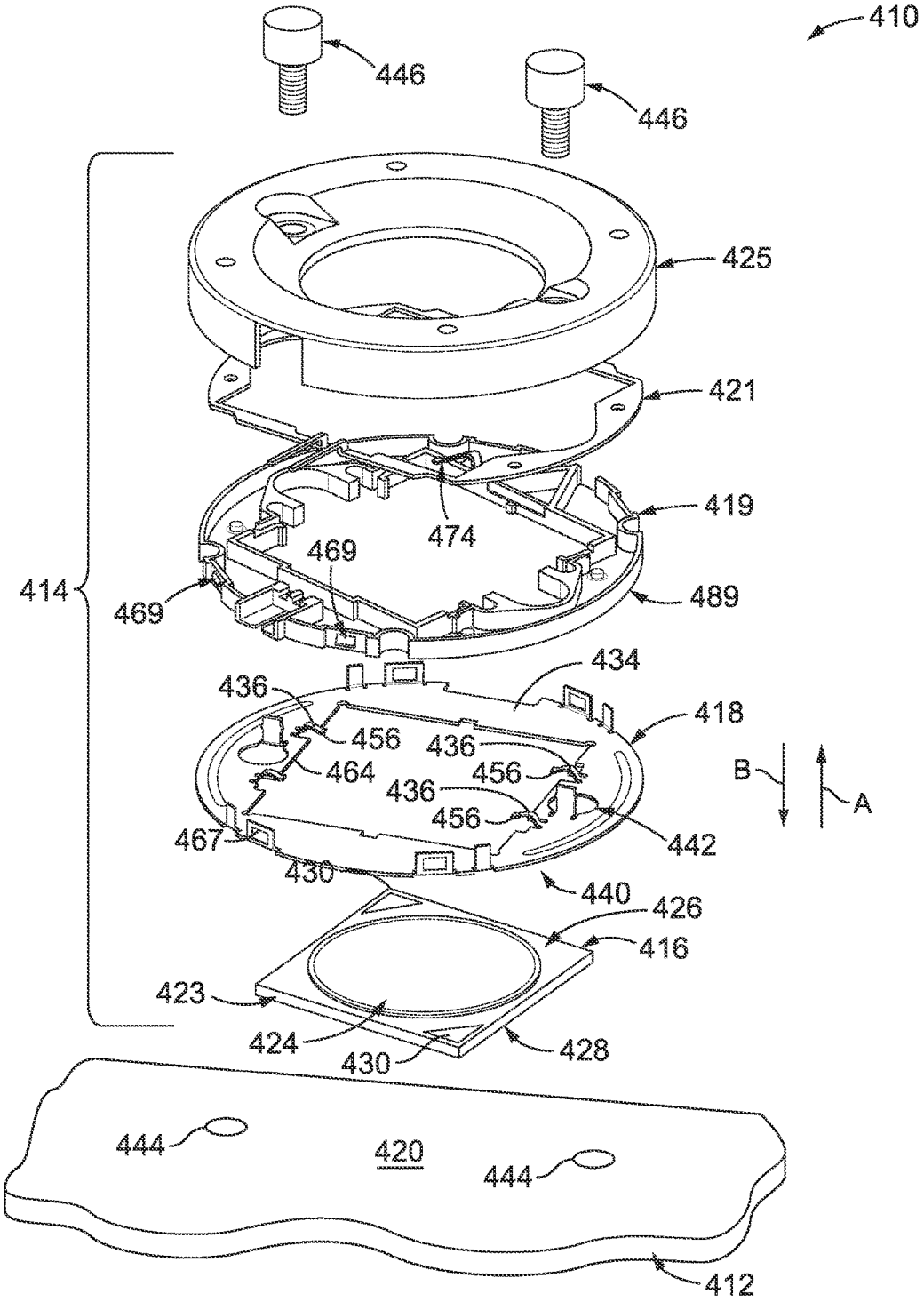
FIG. 8 is an exploded view of another embodiment of a lighting assembly.
Figure 15:
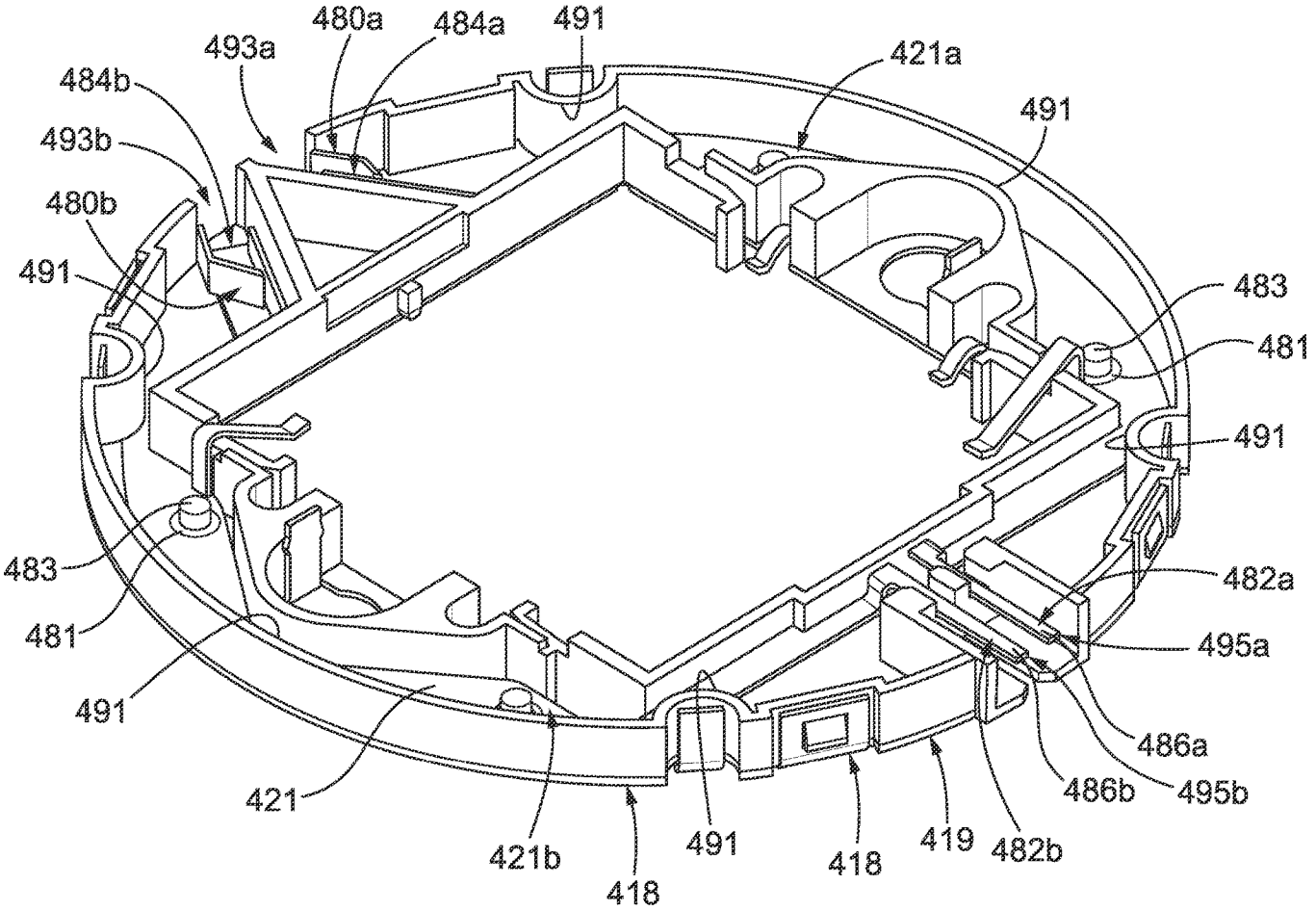
FIG. 15 is a perspective view of the electrical contact member of FIG. 12 and the isolator frame of FIG. 13.

The base frame 418 may be used with or without the cover 425 shown in FIGS. 8 and 15. The body 432 of the base frame 418 may include one or more retention members 466. The base frame 418 may include any number of the retention members 466, each of which may be any type of retention member. In the exemplary embodiment, the retention members 466 are interference-fit tabs that extend from the base 434 outwardly relative to the side 438 of the base 434. Although four are shown, the body 432 of the base frame 418 may include any number of the retention members 466. Moreover, each of the retention members 466 may additionally or alternatively be any other type of retention member, such as, but not limited to, a post, a latch, a spring, a snap-fit member, another type of interference-fit member, an opening, and/or the like.

The body 432 of the base frame 418 may include one or more retention members 467. The base frame 418 may include any number of the retention members 467, each of which may be any type of retention member. Although four are shown, the body 432 of the base frame 418 may include any number of the retention members 467. Moreover, each of the retention members 467 may additionally or alternatively be any other type of retention member, such as, but not limited to, a post, a latch, a spring, an interference-fit member, another type of snap-fit member, an opening, and/or the like.

In some embodiments, the spring fingers 436 extend from the base 434 such that the base 434 and the spring fingers 436 define a unitary body of the base frame 418. In some embodiments, the mounting members 442, the retention members 466, and/or the retention members 467 define a unitary body with the base 434. The unitary body defined by the base 434 and the spring fingers 436 may constitute an approximate entirety of the body 432 of the base frame 418, or the unitary body defined by the base 434 and the spring fingers 436 may constitute only a portion of the body 432. For example, the unitary body defined by the base 434 and the spring fingers 436 may constitute an approximate entirety of the body 432 when the mounting members 442, the retention members 466, and the retention members 467 also define a unitary body with the base 434. In such embodiments wherein the mounting members 442, the retention members 466, the retention members 467, and the spring fingers 436 define a unitary body with the base 434, the body 432 is a one-piece body. Moreover, and for example, the unitary body defined by the base 434 and the spring fingers 436 may constitute only a portion of the body 432 of the clamp 418 when the mounting members 442, the retention members 466, and/or the retention members 467 do not define a unitary body with the base 434.

The body 432 of the base frame 418 may be fabricated using any method, process, structure, means, and/or the like, such as, but not limited to, using a cutting process, using a casting process, using a molding process, using a forming process, and/or the like. When the body 432 is fabricated using a cutting process, the body 432 may be cut from a reel of material, from a blank of material, from an approximately flat sheet of material, from an approximately flat material, from a rod of material, and/or the like. In some embodiments, the body 432 is a cut and formed body that is cut from a material and then formed to include the finished shape of the body 432. Moreover, in some embodiments, the spring fingers 436, the mounting members 442, the retention members 466, and/or the retention members 467 are integrally formed with the base 434.

The body 432 of the base frame 418 may be fabricated from any materials that enable the base frame 418 to function as described and/or illustrated herein. In various embodiments, any portion of or all of the body 432 may be formed of metal. The various components of the body 432 such as the base 434, the mounting members 442, the retention members 466, and/or the spring fingers 436 may be fabricated from the same and/or different materials than each other. In some embodiments, the body 432 includes a material that is a relatively good thermal conductor, for example a metal such as copper, aluminum, or brass, such that the body 432 facilitates transferring heat from the LED package 416 to the support structure 412.

The body 432 of the base frame 418 includes a recess 464, which may have any size and any shape. The recess 464 is optionally sized and/or shaped complementary with the size and/or shape of the LED PCB 422 of the LED package 416, as is shown in the exemplary embodiment.

Figure 10:
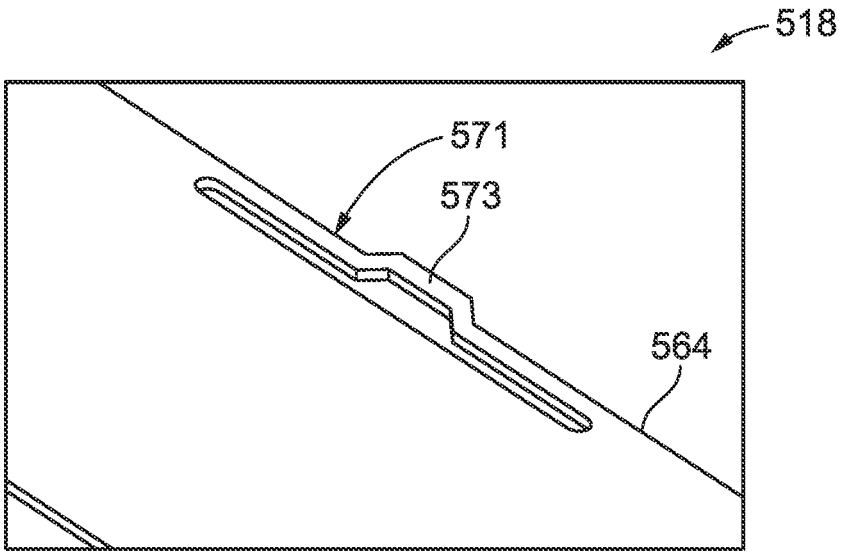
FIG. 10 is a perspective view of another embodiment of a base frame.

Another embodiment of a base frame 518 is shown in FIG. 10. The base frame 518 includes a recess 564. The base frame 518 includes one or more LED mounting members 571 that are configured to engage in physical contact with the LED PCB 422 to hold the LED package 416 within the recess 564. Each LED mounting member 571 may a resilient tab 573 that extends radially inward into the recess 564.

Figure 11:
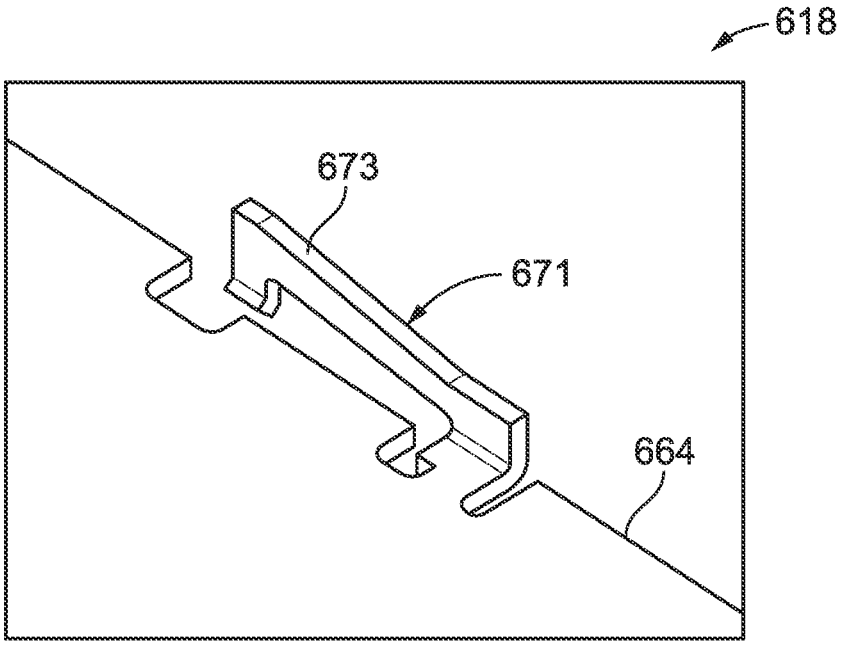
FIG. 11 is a perspective view of another embodiment of a base frame.

Another embodiment of a base frame 618 is shown in FIG. 11, including another LED mounting member 671. The LED mounting member 671 includes a resilient locking latch 673 that extends into a recess 664 of the base frame 618.

Figure 12:
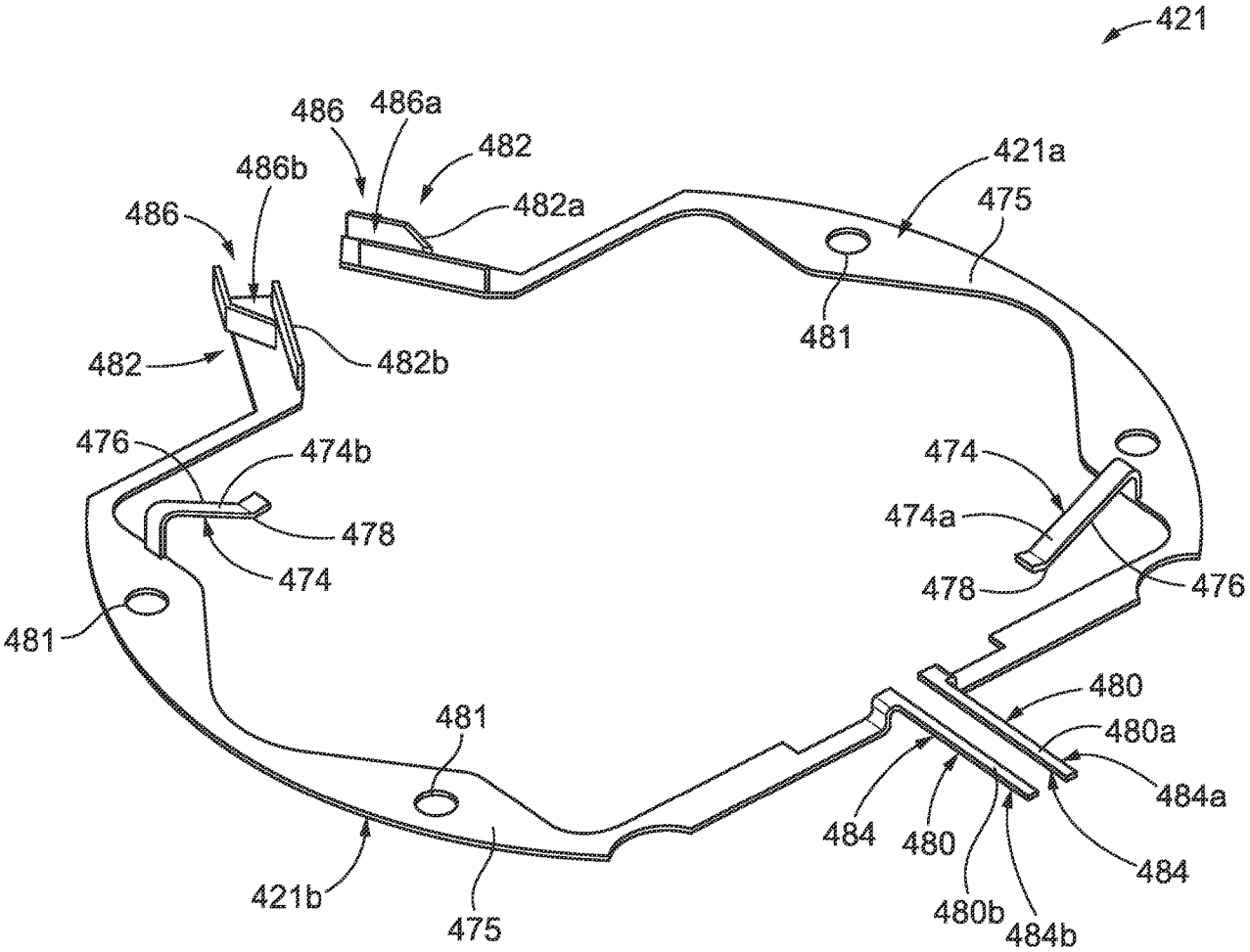
FIG. 12 is a perspective view of an electrical contact member of the lighting assembly of FIG. 8.

The electrical contact member 421 is shown in FIG. 12. The electrical contact member 421 includes a base 475, one or more LED contacts 474, one or more first electrical contacts 480, and one or more second electrical contacts 482.

The base 475 optionally includes one or more locating openings 481. Although four are shown, the electrical contact member 421 may include any number of the locating openings 481.

The LED contacts 474 include fingers 476 that extend radially inward from the base 475. The fingers 476 include mating interfaces 478. Each LED contact 474 may include any number of the fingers 476, and the electrical contact member 421 may include any number of the LED contacts 474. In the exemplary embodiment, the electrical contact member 421 includes two LED contacts 474*a* and 474*b* that provide positive and negative electrical connections for supplying electrical power to the LED 424.

The electrical contact member 421 may include two sub-members 421*a* and 421*b* that are discrete structures from each other and electrically isolated. The sub-member 421*a* includes the LED contact 474*a*, and the sub-member 421*b* includes the LED contact 474*b*. The LED contacts 474*a* and 474*b* are thus electrically isolated from each other.

The first electrical contacts 480 extend from the base 475, and may include any number of electrical contacts 480. In the exemplary embodiment, the first electrical contacts 480 include two first electrical contacts 480*a* and 480*b*. The sub-member 421*a* includes the first electrical contact 480*a*, and the sub-member 421*b* includes the first electrical contact 480*b*. The first electrical contacts 480*a* and 480*b* are thus electrically isolated from each other. Each first electrical contact 480*a* and 480*b* is electrically connected to a corresponding LED contact 474*a* and 474*b*, respectively, through the portion of the base 475 that is defined by the respective sub-member 421*a* and 421*b*. Each first electrical contact 480*a* and 480*b* is configured with a first connection structure 484 for mating with the corresponding first mating contact. The first connection structure 484 may be any type of connection structure that enables the first electrical contact 480 to mate in electrical connection with a corresponding first mating contact. For example, in the exemplary embodiment, the first connection structure 484 of the first electrical contacts 480*a* and 480*b* includes pins 484*a* and 484*b*, respectively, that are configured to be received within receptacles (not shown) of the corresponding first mating contacts.

Each second electrical contact 482 is configured with a second connection structure 486 that is different than the first connection structure 484 of the first electrical contacts 480. The second electrical contacts 482 extend from the base 475, and include any number of electrical contacts 482. In the shown embodiment, the second electrical contacts 482 include two second electrical contacts 482*a* and 482*b*. The sub-member 421*a* includes the second electrical contact 482*a*, and the sub-member 421*b* includes the second electrical contact 482*b*, such that the second electrical contacts 482*a* and 482*b* are electrically isolated from each other. Each second electrical contact 482*a* and 482*b* is electrically connected to a corresponding LED contact 474*a* and 474*b*, respectively, through the portion of the base 475 that is defined by the respective sub-member 421*a* and 421*b*.

Each second electrical contact 482*a* and 482*b* is configured with the second connection structure 486 for mating with a corresponding second mating contact. The second connection structure 486 may be any type of connection structure that is different than the first connection structure 484 and that enables the second electrical contact 482 to mate in electrical connection with the corresponding second mating contact. For example, in the exemplary embodiment, the second connection structure 486 of each of the second electrical contacts 482*a* and 482*b* includes a receiving structure 486*a* and 486*b*, respectively, which is configured to receive the corresponding second mating contact with an inserting arrangement.

The first and second connection structures 484 and 486, respectively, are not limited to the respective pin and receiving structures shown and described herein. Rather, each of first connection structure 484 and each second connection structure 486 may be any type of connection structure that is configured to mate in electrical connection with a mating contact having any type of connection structure. Examples of other types of connection structures 484 and 486 include, but are not limited to, an insulation displacement contact that pierces the insulation of an electrical wire to electrically connect to an electrical conductor of the wire, a crimp connection structure, a weld connection structure, a solder connection structure, a spring arm, a spring finger, a receptacle, and/or the like.

Figure 13:
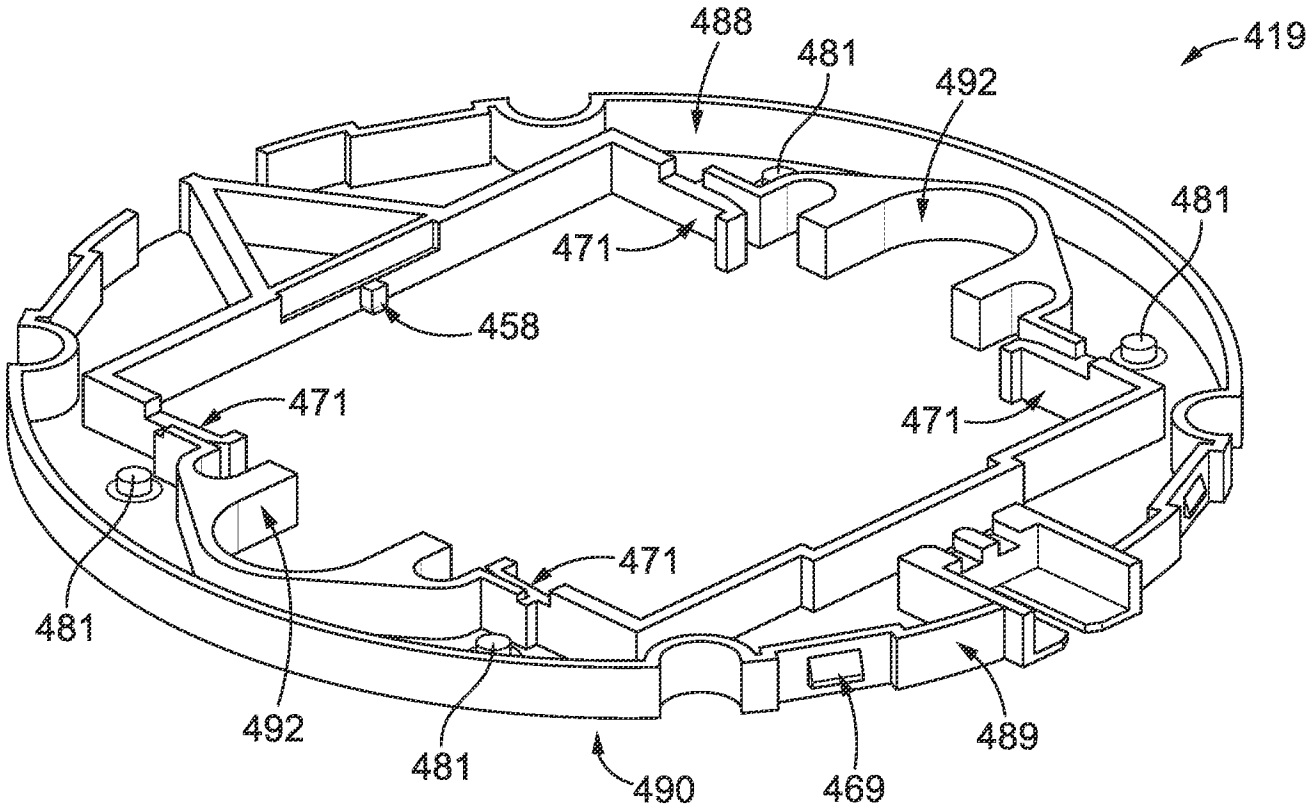
FIG. 13 is a perspective view of an isolator frame of the lighting assembly of FIG. 8.
Figure 14:
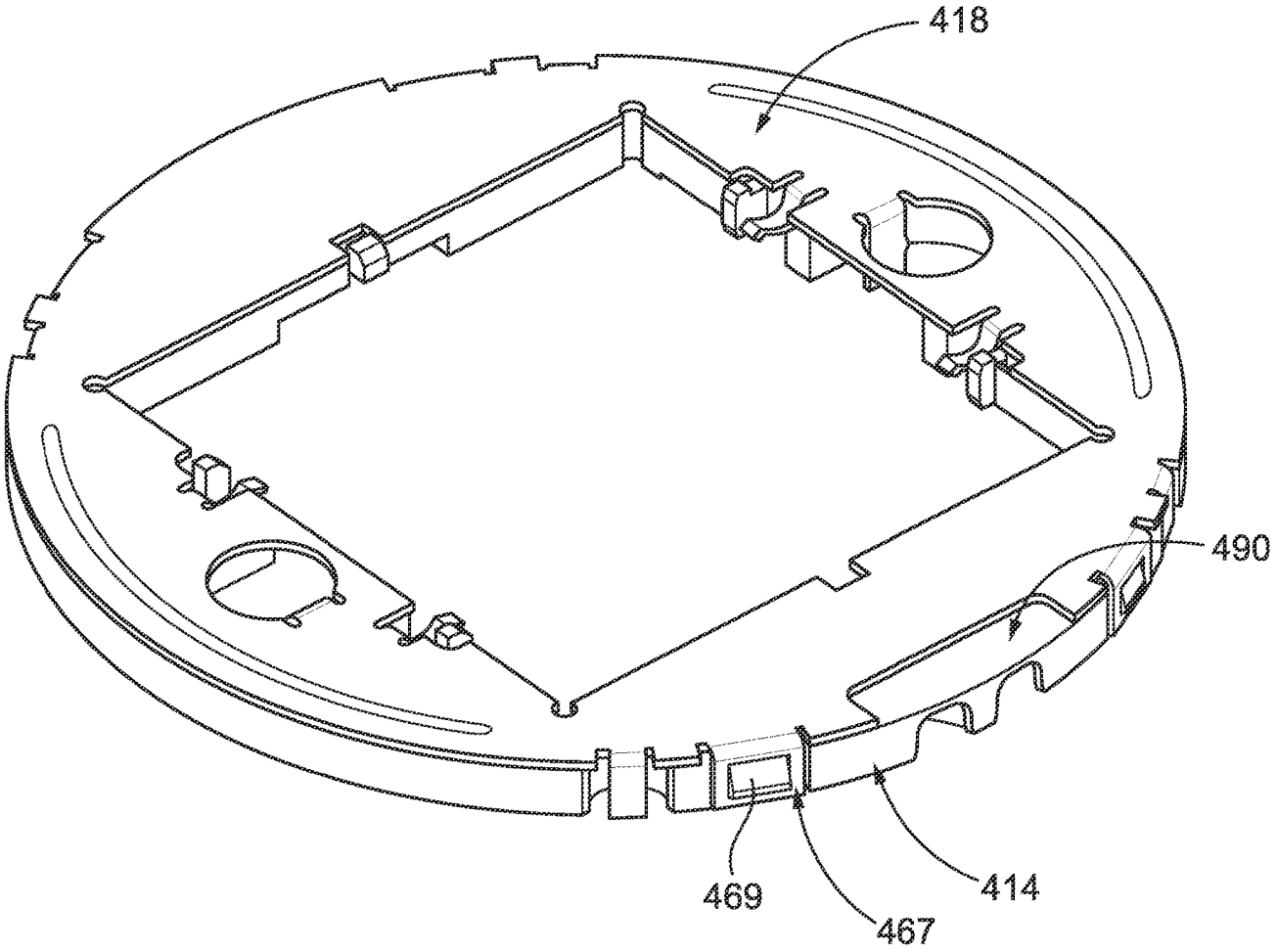
FIG. 14 is a perspective view of the isolator frame of FIG. 13 and the base frame of FIG. 9.

The isolator frame 419 is shown in FIG. 13. The isolator frame 419 includes a dielectric body 489 having opposite sides 488 and 490. The body 489 of the isolator frame 419 extends a thickness from the side 488 to the side 490.

The isolator frame 419 may include one or more mounting members 492, each of which may be any type of mounting member. In the exemplary embodiment, the isolator frame 419 includes two mounting members 492, which are openings, however, each of the mounting members 492 may additionally or alternatively be any other type of mounting member, such as, but not limited to, a post, a latch, a spring, a snap-fit member, an interference-fit member, a rivet, a pop rivet, a threaded fastener, and/or the like.

The isolator frame 419 may also include one or more tabs 469, one or more locating members 458, and one or more LED mounting members 471. LED mounting members 471 may be spring arms. Although four are shown, the isolator frame 419 may include any number of the LED mounting members 471. In addition or alternative to the spring arm, each LED mounting member 471 may include any other structure that enables the LED mounting member 471 to facilitate holding the LED package 416.

The isolator frame 419 may include the locating tabs 483. Although four are shown, the isolator frame 419 may include any number of the locating tabs 481.

Figure 16:
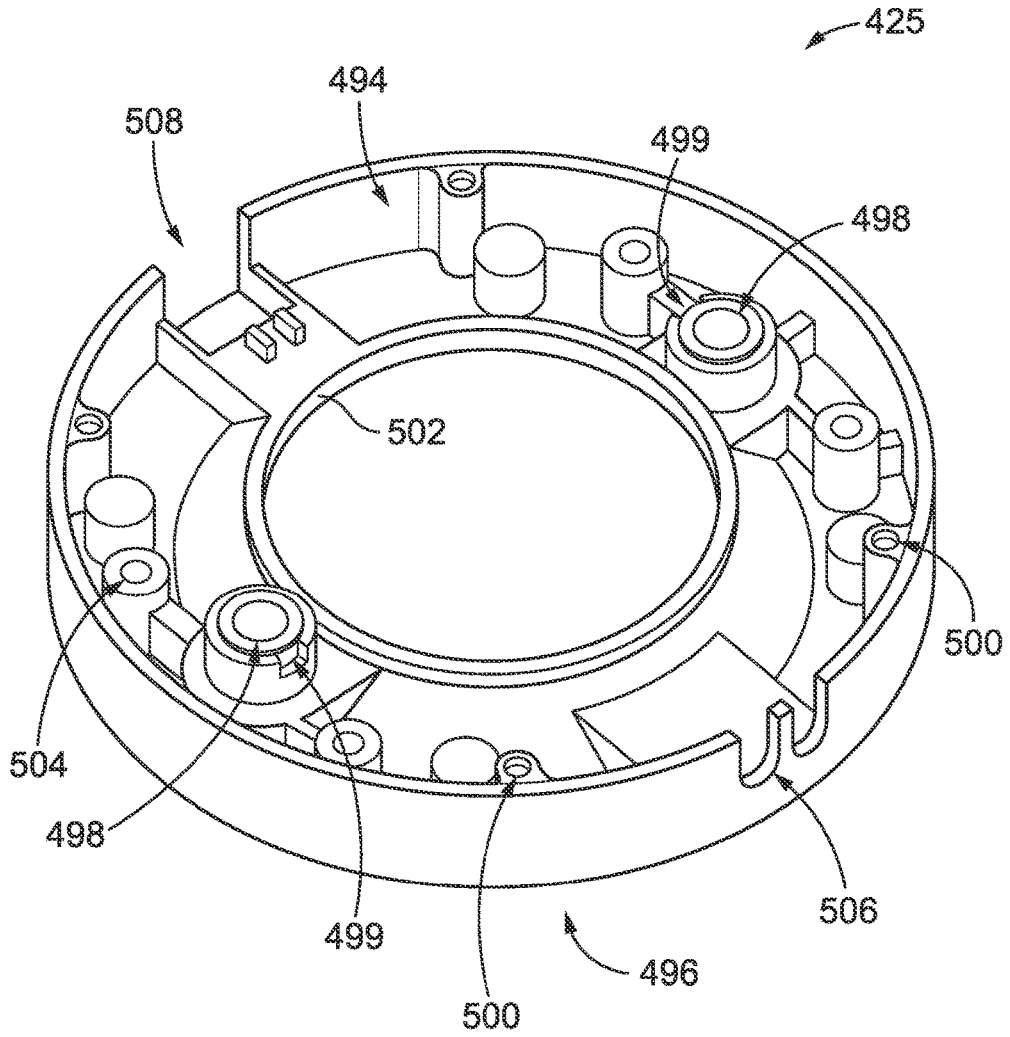
FIG. 16 is a perspective view of a cover of the lighting assembly of FIG. 8.

The cover 425 is shown in FIG. 16. The cover 425 extends a thickness from a side 494 to an opposite side 496.

The cover 425 may include one or more mounting members 498, which may be any type of mounting member. In the shown embodiment, the cover includes two mounting members 498, however, each of the mounting members 498 may additionally or alternatively be any other type of mounting member, such as, but not limited to, a post, a latch, a spring, a snap-fit member, an interference-fit member, a rivet, a pop rivet, a threaded fastener, and/or the like. The cover 425 includes one or more openings 499.

The cover 425 may include one or more retention members 500, each of which may be any type of retention member 500. The cover 425 also includes an opening 502 that enables the LED 424 to be exposed. The opening 502 may have any size and any shape. In the exemplary embodiment, the opening 502 has a circular shape and a complementary size relative to the LED 424. The cover 425 may include one or more optic features (e.g., a lens, a screen, a transparent cover, and/or the like) that extend over the opening 502. The LED 424 may be considered to be exposed by the opening 502 through the optic feature.

The cover 425 may further include openings 504, a first connection entrance 506, and a second connection entrance 508.

The assembly of lighting assembly 410 will now be described in more detail with reference to FIGS. 8, 15, 17, and 18.

The base frame 418 is mounted to the support structure 412 such that the base frame 418 holds the LED package 416 to the support structure 412; the ring structure of the base 434 is configured to extend at least partially around the circumference of the LED PCB 422. The side 440 of the base 434 engages the mounting surface 420 of the support structure 412 when the base 434 is mounted to the support structure 412. Specifically, the base 434 of the base frame 418 is mounted to the support structure 412 using the mounting members 442. The fasteners 446, shown in FIG. 8, are threaded fasteners that are received through the openings of the mounting members 442 and into the openings 444 within the support structure 412. In the shown embodiment, the openings 444 of the support structure 412 are threaded, such that the fasteners 446 threadably connect to the support structure 412. In addition or alternatively, a nut (not shown) is used to secure the fasteners 446 within the openings 444. When the base frame 418 is mounted to the support structure 412, the base 434 engages the support structure 412. Specifically, the side 440 of the base 434 is engaged with the mounting surface 420 of the support structure 412. Alternatively, the side 440 of the base 434 is engaged with a thermal interface material (TIM; not shown) that extends between the base frame 418 and the mounting surface 420.

The LED package 416 is received within the recess 464 of the base frame 418 such that the spring fingers 436 of the base frame 418 are engaged with the LED package 416, and the LED PCB 422 is clamped between the spring fingers 436 and the support structure 412. Specifically, the interfaces 456 of the spring fingers 436 are engaged with the side 426 of the LED PCB 422 such that the spring fingers 436 are deflected in a direction away from the support structure 412, an example of which is represented by the arrow A in FIG. 8. In the deflected positions shown in FIGS. 17, the spring fingers 436 exert the clamping force on the side 426 of the LED PCB 422 that acts in a direction toward the support structure 412, an example of which is represented by the arrow B in FIG. 8. The base frame 418 thus holds the LED package 416 to the support structure 412. The clamping force, or a range thereof, may be selected to facilitate preventing failure of the LED package 416. The clamping force may be sufficiently low to prevent the LED PCB 422 from fracturing (e.g., cracking, breaking, and/or the like), and may be sufficiently high to securely hold the LED package 416 between the base frame 418 and the support structure 412 in a manner that prevents the LED package 416 from vibrating. Further, the clamping force may be sufficiently high to facilitate maintaining a sufficient thermal connection between the LED package 116 and the support structure 412 (and/or between the base frame 418 and the LED package 416 and/or between the base frame 418 and the support structure 412) to facilitate maintaining an operational temperature of the LED package 416 below a predetermined temperature, over an expected lifetime of the LED 424.

The side 428 of the LED PCB 422 is engaged with the mounting surface 420 of the support structure 412 when the LED package 416 is held to the support structure 412 by the base frame 418. In addition or alternatively, when the LED package 416 is held to the support structure 412 by the base frame 418, the side 428 of the LED PCB 422 may engage a TIM that extends between the LED PCB 422 and the support structure 412. The engagement between the LED PCB 422 and the support structure 412 and/or intermediate member may facilitate the transfer of heat away from the LED package 416. Moreover, the base frame 418 may facilitate transferring heat away from the LED package 416. For example, the body 434 of the base frame 418 may be connected in thermal communication with the LED package 416 such that the body 434 is configured to transfer heat from the LED package 416 to the support structure 412.

Figure 18:
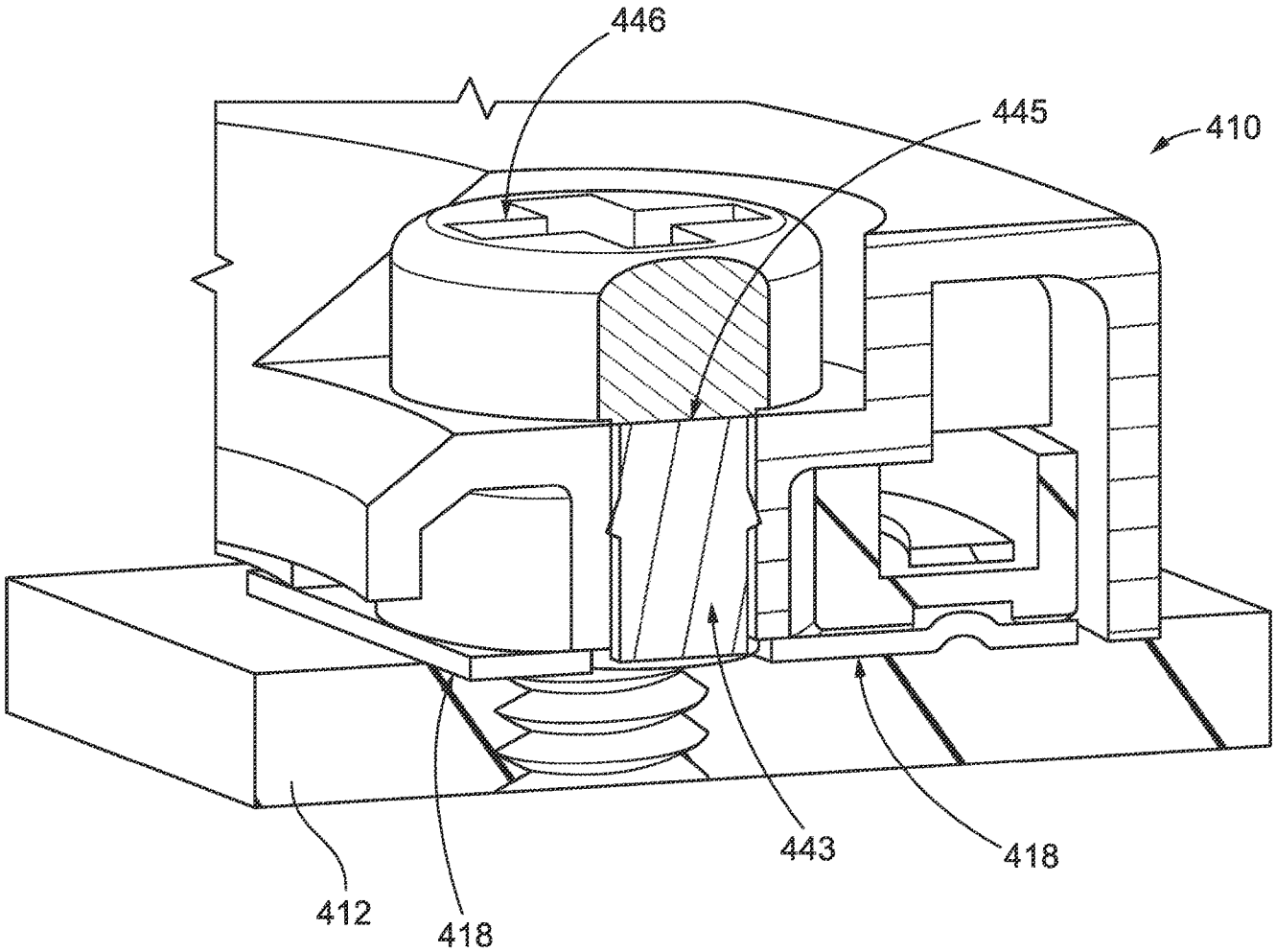
FIG. 18 is a sectional view of the lighting assembly of FIG. 8.

As shown in FIG. 18, the ends 445 of the anvils 443 of the base frame 418 are engaged by the corresponding fastener 446 such that the fastener 446 applies a clamping force to the base frame 418. The clamping force provided by the cooperation between the anvils 443 and the fasteners 446 may facilitate maintaining a sufficient thermal connection between the LED package 116 and the support structure 412.

The isolator frame 419 is positioned between the electrical contact member 421 and the base frame 418 such that the dielectric body 489 of the isolator frame 419 electrically isolates the electrical contact member 421 from the base frame 418. The one or more retention members 467 mechanically connect the body 432 to the isolator frame 419. The retention members 467 receive tabs 469 of the isolator frame 419 therein. In some embodiments, in addition or alternative to the retention members 467, one or more of the mounting members 442 may be used to mechanically connect the body 432 of the base frame 418 to the isolator frame 419.

The one or more mounting members 492 are used to mount the isolator frame 419 to the support structure 412. Each mounting member 492 cooperates with a corresponding opening 444 of the support structure 412, receiving fasteners 446 to mount the isolator frame 419 to the support structure 412. The one or more LED mounting members 471 may further engage in physical contact with the LED PCB 422 to hold the LED package 416 within the recess 464. The one or more locating members 458 engage the LED PCB 422 to locate the LED package 416 relative to the recess 464, for example, by centering the LED PCB 422 within the recess 464.

FIG. 15 shows the electrical contact member 421 held by the isolator frame 419. The base frame 418 is also shown in FIG. 15 as mechanically connected to the isolator frame 419. The sub-members 421*a* and 421*b* of the electrical contact member 421 are received within various corresponding slots 491 of the isolator frame 419. The locating tabs 483 of the isolator frame 419 are received within the locating openings 481 of the sub-members 421*a* and 421*b* of the electrical contact member 421. Optionally, and in addition or alternative to the optional interference and/or snap-fit connection between the locating openings 481 and the locating tabs 483, the slots 491 receive the electrical contact member 421 with a snap and/or interference-fit to facilitate holding the electrical contact member 421 to the isolator frame 421.

The first connection structures 484*a* and 484*b* of the first electrical contacts 480*a* and 480*b*, respectively, of the electrical contact member 421 are exposed within respective first connection openings 493*a* and 493*b* of the isolator frame 419 for mating with first mating contacts (not shown). As can be seen in FIG. 15, the first electrical contacts 480*a* and 480*b* are held by the isolator frame 419 such that the first electrical contacts 480*a* and 480*b* are electrically isolated from each other. The pins 486*a* and 486*b* of the respective second electrical contacts 482*a* and 482*b* of the electrical contact member 421 are exposed within respective second connection openings 495*a* and 495*b* of the isolator frame 419 for mating with second mating contacts (not shown). The second electrical contacts 482*a* and 482*b* are held by the isolator frame 419 such that the second electrical contacts 482*a* and 482*b* are electrically isolated from each other.

Figure 17:
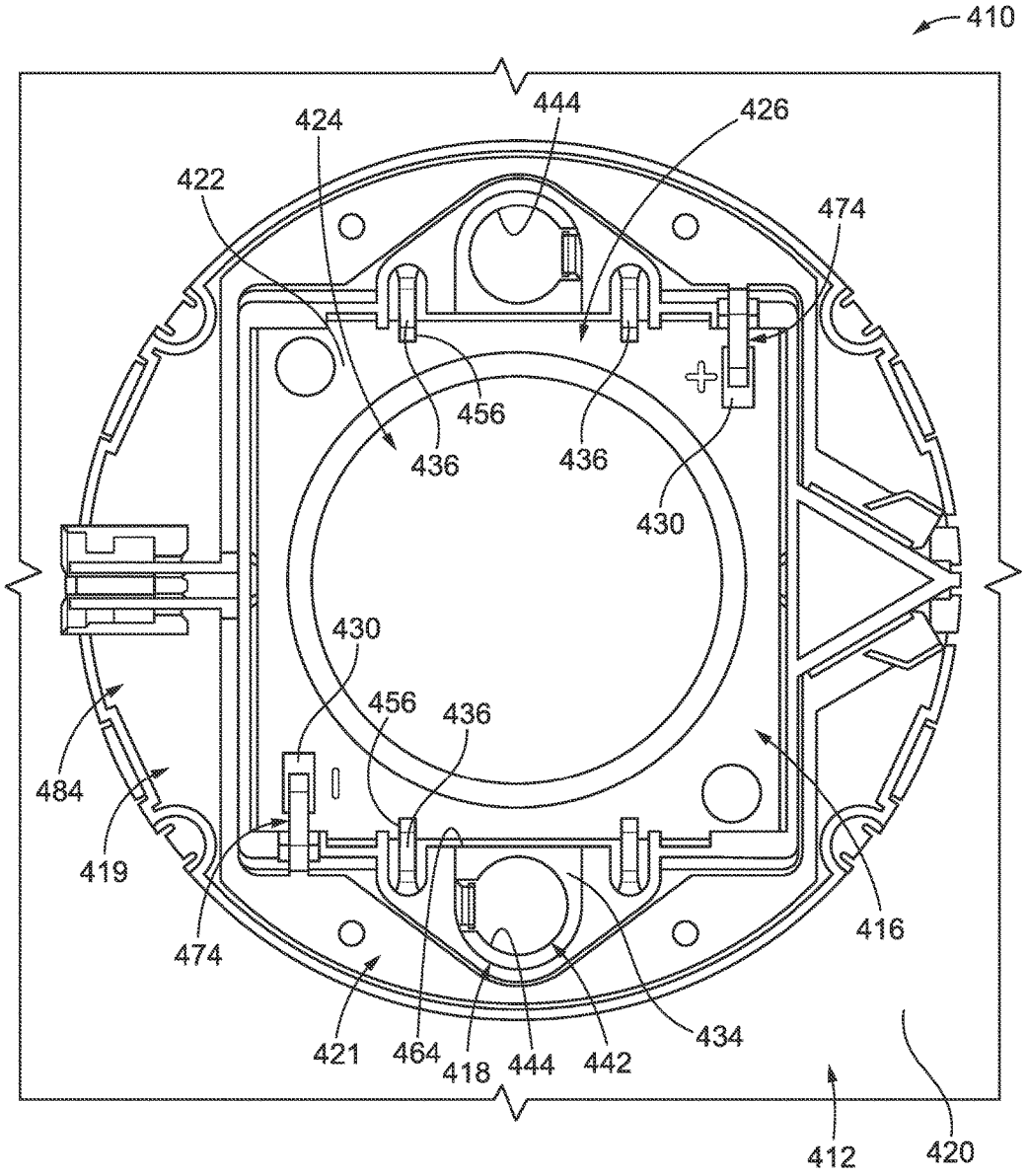
FIG. 17 is a top plan view of the lighting assembly of FIG. 8.

As shown in FIG. 17, the LED contacts 474 are engaged in electrical connection with the corresponding power pads 430 of the LED PCB 422 to electrically connect the electrical contact member 421 to the LED PCB 422, and thus to the LED 424. The fingers 476 include mating interfaces 478 at which the LED contacts 474 are configured to engage the corresponding power pads 430 of the LED PCB 422. The first electrical contacts 480 and the second electrical contacts 482 can be selectively used to supply the LED package 416 with electrical power through mating contacts of different connection structures. Two first electrical contacts 480*a* and 480*b* provide positive and negative electrical connections, respectively, for supplying electrical power to the LED 424. Each first electrical contact 480*a* and 480*b* is configured to mate with a corresponding first mating contact for example the mating contact of an electrical power supply. The two second electrical contacts 482*a* and 482*b* also provide positive and negative electrical connections, respectively, for supplying electrical power to the LED 424. The second electrical contacts 482*a* and 482*b* are configured to mate with the second mating contacts. A stripped end of an electrical wire (not shown) that defines the second mating contact is poked into the receiving structure 486 to establish an electrical connection between the electrical wire and the second electrical contact 482.

The cover 425 extends over the LED package 416, the base frame 418, the isolator frame 419, and the electrical contact member 421, with the side 494 of the cover 425 facing toward the mounting surface 420. Retention members 466 mechanically connect the body 432 to retention members 500. In some embodiments, in addition or alternative to the retention members 466, one or more of the mounting members 442 may be used to mechanically connect the body 432 of the base frame 418 to the cover 425. Furthermore, the one or more openings 499 receive the anvils 443 of the base frame 418. The openings 504 receive the locating tabs 483 of the isolator frame 419 therein, the first connection entrance 506 exposes the receiving structures 484*a* and 484*b* of the first electrical contacts 480*a* and 480*b*, and the second connection entrances 508 expose the pins 486*a* and 486*b* of the respective second electrical contacts 482*a* and 482*b*.

The one or more mounting members 498 are used to mount the cover 425 to the support structure 412. Each mounting member 498 cooperates with a corresponding mounting feature (e.g., the openings 444 shown in FIGS. 8 and 17) of the support structure 412 to mount the cover 425 to the support structure 412. mounting members 498, which are openings that are configured to receive the fasteners 446 shown in FIGS. 8 and 18.

Figure 19:
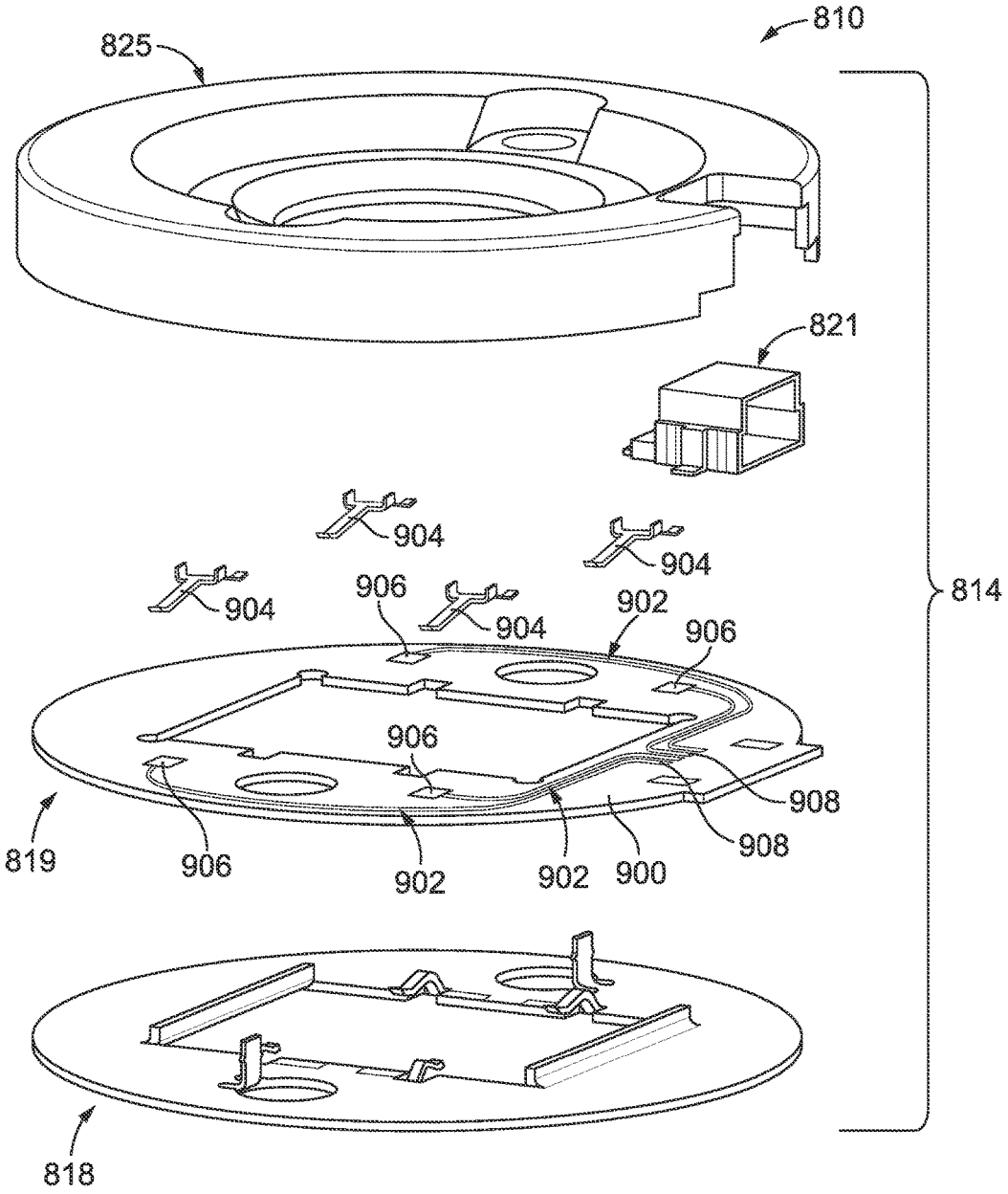
FIG. 19 is an exploded view of another embodiment of a lighting assembly.

Lighting assembly 810 according to another embodiment of the invention is shown in FIG. 19. The lighting assembly 810 includes a support structure (not shown) and a socket assembly 814 that is mounted to the support structure. The socket assembly 814 includes an LED package (not shown), a metal base frame 818, an isolator PCB 819, an electrical connector 821, and a cover 825. The base frame 818 is substantially similar to the base frame 418 and therefore will not be described in more detail herein.

The isolator PCB 819 includes a dielectric substrate 900 and electrical circuits 902 disposed on the substrate 900. Electrical contacts 904 are held by the isolator PCB for electrically connecting the electrical contacts 906 of the electrical circuits 902 to electrical power pads (not shown) of the LED package. The electrical connector 821 is held by the isolator PCB 819 such that the electrical connector 821 is electrically connected to electrical contacts 908 of the electrical circuits 902. The electrical connector 821 is configured to be mated with a mating connector (not shown) for supplying electrical power to the LED package through the isolator PCB 819. The socket assembly 814 may include any number of each of the electrical circuits 902, the electrical contacts 904, the electrical contacts 906, and the electrical contacts 908.

What is claimed is:

1. A socket assembly comprising:

a light emitting diode (LED) package having an LED printed circuit board (PCB) and a power pad disposed on the LED PCB;

a base frame having a base mounted to a support structure and a spring finger extending from the base, the spring finger directly contacting the LED PCB and configured to apply a clamping force to the LED PCB that acts in a direction toward the support structure;

an isolator frame mounted to the support structure; and an electrical contact having an LED contact directly contacting and electrically connected to the power pad of the LED PCB, the electrical contact disposed within the isolator frame such that the isolator frame electrically isolates the base frame from the electrical contact, the isolator frame is disposed between the base frame and the electrical contact in a direction extending perpendicular to a plane defined by the LED PCB.

2. The socket assembly of claim 1, further comprising a cover that extends over the base frame, the isolator frame, and the LED package, the cover having an opening that exposes an LED of the LED package.

3. The socket assembly of claim 1, wherein the base frame is in thermal communication with the LED package.

4. The socket assembly of claim 1, wherein a threaded fastener engages an anvil of the base frame and applies a clamping force to the base frame that acts in a direction toward the support structure.

5. The socket assembly of claim 1, wherein the LED package is disposed within a recess of the base frame, the base frame having an LED mounting member contacting the LED PCB and holding the LED PCB within the recess.

6. The socket assembly of claim 1, wherein the LED package is disposed within a recess of the base frame, and the isolator frame has an LED mounting member contacting the LED PCB and holding the LED PCB within the recess.

7. The socket assembly of claim 1, wherein a retention feature of the isolator frame mechanically connects with a retention member of the base frame.

8. The socket assembly of claim 1, further comprising a cover having an opening that exposes an LED of the LED package and a retention feature mechanically connecting with a retention member of the base frame.

9. The socket assembly of claim 1, wherein the isolator frame has an isolator PCB electrically connected to the electrical contact, the LED PCB, and an electrical power supply.

10. The socket assembly of claim 1, wherein a portion of the base frame is metal.

11. A socket assembly comprising:

a light emitting diode (LED) package having an LED printed circuit board (PCB) with an LED mounted thereto;

a metal base frame having a base mounted to a support structure and a spring finger extending from the base, the spring finger configured to apply a clamping force to the LED PCB that acts in a direction toward the support structure;

an isolator PCB electrically connected to an electrical power supply; and an electrical contact electrically connected to the LED PCB and disposed within the isolator PCB such that the electrical contact electrically connects the isolator PCB to the LED PCB.

12. The socket assembly of claim 11, further comprising an electrical connector electrically connected to the isolator PCB, the electrical connector being configured to be mated with a mating connector for supplying electrical power to the LED through the isolator PCB.

13. The socket assembly of claim 11, wherein the base frame is in thermal communication with the LED package.

14. The socket assembly of claim 1, wherein the isolator frame is disposed between a portion of the electrical contact and the LED PCB.

15. The socket assembly of claim 14, wherein a side of the portion of the electrical contact is disposed directly on a surface of the isolator frame.

16. The socket assembly of claim 2, wherein the cover overlaps an entirety of the base frame in a direction extending perpendicular to a plane defined by the LED PCB.

17. A socket assembly comprising:

a light emitting diode (LED) package having an LED printed circuit board (PCB) and a power pad disposed on the LED PCB;

a base frame having a base mounted to a support structure and a spring finger extending from the base, the spring finger directly contacting the LED PCB and configured to apply a clamping force to the LED PCB that acts in a direction toward the support structure;

an isolator frame mounted to the support structure; and an electrical contact having an LED contact directly contacting and electrically connected to the power pad of the LED PCB, the electrical contact disposed within the isolator frame such that the isolator frame electrically isolates the base frame from the electrical contact, the isolator frame is disposed between a portion of the electrical contact and the LED PCB.

18. The socket assembly of claim 17, wherein a side of the portion of the electrical contact is disposed directly on a surface of the isolator frame.

19. A socket assembly comprising:

a light emitting diode (LED) package having an LED printed circuit board (PCB) and a power pad disposed on the LED PCB;

a base frame having a base mounted to a support structure and a spring finger extending from the base, the spring finger directly contacting the LED PCB and configured to apply a clamping force to the LED PCB that acts in a direction toward the support structure;

an isolator frame mounted to the support structure and having an isolator PCB; and an electrical contact having an LED contact directly contacting and electrically connected to the power pad of the LED PCB, the electrical contact disposed within the isolator frame such that the isolator frame electrically isolates the base frame from the electrical contact, the isolator PCB is electrically connected to the electrical contact, the LED PCB, and an electrical power supply.

* * * * *